US010100424B2

(12) United States Patent
Fujikata et al.

(10) Patent No.: US 10,100,424 B2
(45) Date of Patent: Oct. 16, 2018

(54) METHOD OF ADJUSTING PLATING APPARATUS, AND MEASURING APPARATUS

(71) Applicant: EBARA CORPORATION, Tokyo (JP)

(72) Inventors: Jumpei Fujikata, Tokyo (JP); Masashi Shimoyama, Tokyo (JP); Yuji Araki, Tokyo (JP); Mizuki Nagai, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 213 days.

(21) Appl. No.: 15/182,469

(22) Filed: Jun. 14, 2016

(65) Prior Publication Data

US 2016/0369422 A1 Dec. 22, 2016

(30) Foreign Application Priority Data

Jun. 18, 2015 (JP) ..... 2015-122876

(51) Int. Cl.
*C25D 7/12* (2006.01)
*C25D 21/12* (2006.01)
(Continued)

(52) U.S. Cl.
CPC ..... *C25D 21/12* (2013.01); *C25D 5/00* (2013.01); *C25D 7/12* (2013.01); *C25D 17/001* (2013.01);
(Continued)

(58) Field of Classification Search
CPC ..... C25D 17/001; C25D 21/12
(Continued)

(56) References Cited

U.S. PATENT DOCUMENTS 6,015,462 A * 1/2000 Doolittle ..... C25D 7/12 118/668
6,402,923 B1 6/2002 Mayer et al.
(Continued)

FOREIGN PATENT DOCUMENTS

JP 2000-087295 A 3/2000
JP 2009-155726 A 7/2009

OTHER PUBLICATIONS

European Patent Application No. 16174474.3; Extended Search Report; dated Oct. 24, 2016; 6 pages.

*Primary Examiner* — Brian W Cohen
(74) *Attorney, Agent, or Firm* — Baker & Hostetler LLP

(57) ABSTRACT

There is provided a method of adjusting a plating apparatus and a measuring apparatus that can obtain position adjustment amounts/a position adjustment amount of a substrate holder, an anode holder, a regulation plate, and/or a paddle without carrying out plating treatment. There is provided the method of adjusting the plating apparatus that has a plating bath configured to be able to hold the substrate holder, the anode holder, and an electric field adjusting plate. The method of adjusting the plating apparatus has the steps of: installing a first jig at a position in the plating bath where the substrate holder is installed; installing a second jig at a position in the plating bath where the anode holder or the electric field adjusting plate is installed; measuring a positional relation between the first jig and the second jig installed in the plating bath using a sensor included in either of the first jig and the second jig; and adjusting an installation position of the substrate holder, the anode holder, or the electric field adjusting plate based on the measured positional relation.

11 Claims, 16 Drawing Sheets

(51) Int. Cl.

| | |
|---|---|
| ***C25D 17/06*** | (2006.01) |
| ***C25D 17/00*** | (2006.01) |
| ***C25D 17/12*** | (2006.01) |
| ***C25D 5/00*** | (2006.01) |

(52) U.S. Cl.
CPC ..... *C25D 17/007* (2013.01); *C25D 17/008* (2013.01); *C25D 17/06* (2013.01); *C25D 17/12* (2013.01)

(58) Field of Classification Search
USPC ..... 205/157, 96
See application file for complete search history.

(56) References Cited

U.S. PATENT DOCUMENTS

| | | | |
|---|---|---|---|
| 8,177,944 | B2 | 5/2012 | Saito et al. |
| 2009/0139871 | A1 | 6/2009 | Saito et al. |

* cited by examiner

METHOD OF ADJUSTING PLATING APPARATUS, AND MEASURING APPARATUS

TECHNICAL FIELD

The present invention relates to a method of adjusting a plating apparatus, and a measuring apparatus.

BACKGROUND ART

Conventionally, it has been a practice to form a wiring in a fine wiring groove, a hole, or a resist opening part provided on a surface of a substrate such as a semiconductor wafer, and to form a bump (a projecting electrode) electrically connected to an electrode etc. packaged on the surface of the substrate. As a method of forming the wiring and the bump, for example, an electrolytic plating method, a deposition method, a printing method, a ball bump method, etc. have been known. The electrolytic plating method in which miniaturization can be made and in which performance is comparatively stable has been increasingly used along with the increase in the number of I/O and the decrease in pitch of a semiconductor chip in recent years.

In a plating apparatus that performs electrolytic plating, generally, an anode and a substrate are arranged to be opposed to each other in a plating bath that stores plating liquid, and a voltage is applied to the anode and the substrate. Hereby, a plated metal layer is formed on a substrate surface. In addition, the plating apparatus has an opening part through which an electric field between the anode and the substrate passes, and a regulation plate for adjusting the electric field may be arranged between the anode and the substrate (for example, refer to Japanese Patent Laid-Open No. 2009-155726). In addition, it has also been known to provide a paddle between the regulation plate and the substrate, the paddle being for stirring the plating liquid (for example, refer to Japanese Patent Laid-Open No. 2009-155726).

In order to uniformly form the plated metal layer on the substrate in the plating apparatus, it is desirable that a center of the substrate, a center of the anode, and a center of an opening part of the regulation plate are located on the same straight line, and that the substrate, the anode, and the regulation plate are parallel to each other.

Since strong-acid plating liquid is stored in the plating bath, the plating bath includes resin having chemical resistance. Similarly, a substrate holder, an anode holder, and the regulation plate that are immersed in the strong-acid plating liquid include resin having chemical resistance. Machining accuracy of resin is generally inferior to that of metal. For this reason, dimensional accuracy of the plating bath, the substrate holder, the anode holder, and the regulation plate is comparatively poor, and it is difficult to appropriately align them. Even though plating is performed to the substrate in the above-described state, a layer having desired in-plane uniformity cannot be formed.

Conventionally, in order to appropriately align the substrate holder, the anode holder, and the regulation plate, they were arranged in the plating bath, and the plated metal layer was actually formed on the substrate. Specifically, position adjustment amounts of the substrate holder, the anode holder, the regulation plate, and a paddle in the plating bath were predicted based on layer thickness distribution of the plated metal layer, and positions of the substrate holder, the anode holder, the regulation plate, and the paddle were adjusted.

However, in a case of adjusting a position of each member by the above-described conventional method, since it is necessary to actually form the layer on the substrate and to subsequently perform layer thickness measurement, a lot of time is required to set up the plating apparatus. In addition, there is also a problem that extra cost of a setting-up substrate is needed since the substrate on which the layer has been formed is not used for a product.

The present invention has been made in view of the above-described problems, and an object thereof is to provide a method of adjusting a plating apparatus and a measuring apparatus that can obtain position adjustment amounts (a position adjustment amount) of a substrate holder, an anode holder, a regulation plate, and/or a paddle without carrying out plating treatment.

SUMMARY OF INVENTION

According to one mode of the present invention, there is provided a method of adjusting a plating apparatus that has a plating bath configured to be able to hold a substrate holder, an anode holder, and an electric field adjusting plate. The method of adjusting the plating apparatus has the steps of: installing a first jig at a position in the plating bath where the substrate holder is installed; installing a second jig at a position in the plating bath where the anode holder or the electric field adjusting plate is installed; measuring a positional relation between the first jig and the second jig installed in the plating bath using sensors included in either of the first jig and the second jig; and adjusting an installation position of the substrate holder, the anode holder, or the electric field adjusting plate based on the measured positional relation.

In one mode of the above-described method of adjusting the plating apparatus, the sensors included in either of the first jig and the second jig include a position measuring sensor, the other of the first jig and the second jig has a position measuring member, the step of measuring the positional relation includes a step in which the position measuring sensor measures a distance from a reference position to the position measuring member in an in-plane direction of a surface of the first jig, the surface being opposed to the second jig, and the step of adjusting the installation position includes a step of adjusting an installation position of the substrate holder, the anode holder, or the electric field adjusting plate in the in-plane direction based on the measured distance.

In one mode of the above-described method of adjusting the plating apparatus, the position measuring member is a position measuring pin that protrudes toward the opposing first jig or second jig, and the position measuring sensor is configured to be able to numerically display a distance from a reference position to the position measuring pin in an in-plane direction of the substrate holder.

One mode of the above-described method of adjusting the plating apparatus has the steps of: arranging in a desired positional relation the first jig and the second jig that have not been installed in the plating bath; and measuring the reference position of the position measuring member by the position measuring sensor in a state where the first jig and the second jig are arranged in the desired positional relation.

In one mode of the above-described method of adjusting the plating apparatus, the sensors included in either of the first jig and the second jig include at least three distance measuring sensors, the other of the first jig and the second jig has a distance measuring member, the step of measuring the positional relation includes a step in which the distance measuring sensor measures a distance from the distance measuring sensor to the distance measuring member, and the step of adjusting the installation position includes a step of adjusting an inclination of the substrate holder, the anode holder, or the electric field adjusting plate, or a position thereof in a normal direction of the substrate holder, based on the measured distance.

In one mode of the above-described method of adjusting the plating apparatus, the distance measuring member is a distance measuring pin that protrudes toward the opposing first jig or second jig, and the distance measuring sensor is configured to be able to numerically display the distance from the distance measuring sensor to the distance measuring pin.

One mode of the above-described method of adjusting the plating apparatus has the steps of: arranging in a desired positional relation the first jig and the second jig that have not been installed in the plating bath; and measuring the distance to the distance measuring member by the distance measuring sensor in a state where the first jig and the second jig are arranged in the desired positional relation.

In one mode of the above-described method of adjusting the plating apparatus, the first jig and the second jig have at least two angle measuring reference positions, respectively, the step of measuring the positional relation includes a step of detecting presence/absence of a deviation of rotation angles of the angle measuring reference position formed at the first jig and the angle measuring reference position formed at the second jig, the rotation angles being around the normal direction of the substrate holder, and the step of adjusting the installation position includes a step of adjusting the rotation angle of the substrate holder, the anode holder, or the electric field adjusting plate based on the measured deviation of the rotation angles.

In one mode of the above-described method of adjusting the plating apparatus, the first jig and the second jig have angle measuring holes in the angle measuring reference positions, respectively, and the step of measuring the positional relation includes a step of detecting the presence/absence of the deviation of the rotation angles by inserting an angle measuring pin in the angle measuring hole formed in the first jig and the angle measuring hole formed in the second jig.

One mode of the above-described method of adjusting the plating apparatus has the steps of: arranging in a desired positional relation the first jig and the second jig that have not been installed in the plating bath; and aligning positions of the angle measuring hole formed in the first jig and the angle measuring hole formed in the second jig in a state where the first jig and the second jig are arranged in the desired positional relation.

In one mode of the above-described method of adjusting the plating apparatus, the plating apparatus has a paddle provided between the anode holder and the substrate holder, and the above-described method of adjusting the plating apparatus has the steps of: measuring a positional relation between the first jig and the paddle installed in the plating bath; and adjusting an installation position of the substrate holder or the paddle based on the measured positional relation.

According to the other one mode of the present invention, there is provided a method of adjusting a plating apparatus that has a plating bath configured to be able to hold a substrate holder and an anode holder. The method of adjusting the plating apparatus has the steps of: installing a first jig at a position in the plating bath where the substrate holder is installed; installing a second jig at a position in the plating bath where the anode holder is installed; measuring a positional relation between the first jig and the second jig; and adjusting an installation position of the substrate holder or the anode holder based on the measured positional relation.

According to the other one mode of the present invention, there is provided a measuring apparatus that measures positions in a plating bath where a substrate holder, an anode holder, and an electric field adjusting plate are arranged. The measuring apparatus has: a first jig installed at a position in the plating bath where the substrate holder is installed; and a second jig installed at a position in the plating bath where the anode holder or the electric field adjusting plate is installed. Additionally, in the measuring apparatus, either of the first jig and the second jig includes sensors, and the sensors are configured to measure a positional relation between the first jig and the second jig.

In one mode of the above-described measuring apparatus, the sensors included in either of the first jig and the second jig include a position measuring sensor, the other of the first jig and the second jig has a position measuring member, and the position measuring sensor is configured to measure a distance from a reference position to the position measuring member in a surface of the first jig, the surface being opposed to the second jig.

In one mode of the above-described measuring apparatus, the position measuring member is a position measuring pin that protrudes toward the first jig or the second jig, and the position measuring sensor is configured to be able to numerically display a distance from a reference position to the position measuring pin in an in-plane direction of the substrate holder.

In one mode of the above-described measuring apparatus, the sensors included in either of the first jig and the second jig include at least three distance measuring sensors, the other of the first jig and the second jig has a distance measuring member, and the distance measuring sensor is configured to measure a distance from the distance measuring sensor to the distance measuring member.

In one mode of the above-described measuring apparatus, the distance measuring member is a distance measuring pin that protrudes toward the first jig or the second jig, and the distance measuring sensor is configured to be able to numerically display the distance from the distance measuring sensor to the distance measuring pin.

In one mode of the above-described measuring apparatus, the measuring apparatus has: a distance holding member configured to hold a distance between the first jig and the second jig; and a reference plate configured to abut against side surfaces of the first jig and the second jig. Additionally, in the measuring apparatus, the sensors measure a positional relation between the first jig and the second jig in a state where the distance between the first jig and the second jig, and side surface positions thereof are held by the distance holding member and the reference plate.

In one mode of the above-described measuring apparatus, the first jig and the second jig have at least two angle measuring holes, respectively, and a pin is inserted in the respective angle measuring holes in a state where a position of the angle measuring hole of the first jig and a position of the angle measuring hole of the second jig are aligned.

In one mode of the above-described measuring apparatus, the plating apparatus has a paddle provided between the anode holder and the substrate holder, and the sensors are configured to measure a positional relation between the first jig or the second jig and the paddle.

According to the other one mode of the present invention, a plating apparatus is provided. The plating apparatus includes: a plating bath configured to be able to house a substrate holder, an anode holder opposed to the substrate holder, and an electric field adjusting plate arranged between the substrate holder and the anode holder; and a data processing device configured to record data measured by sensors included in either one of a first jig installed at a position in the plating bath where the substrate holder is installed, and a second jig installed at a position in the plating bath where the anode holder or the electric field adjusting plate is installed, the data indicating a positional relation between the first jig and the second jig, and to calculate a comparison value of the data and data recorded in the past.

According to the present invention, there can be provided a method of adjusting a plating apparatus and a measuring apparatus that can obtain position adjustment amounts (a position adjustment amount) of a substrate holder, an anode holder, a regulation plate, and/or a paddle without carrying out plating treatment. Eventually, a time required for setup of the plating apparatus can be reduced, and cost can also be reduced.

DESCRIPTION OF EMBODIMENTS

Figure 1:
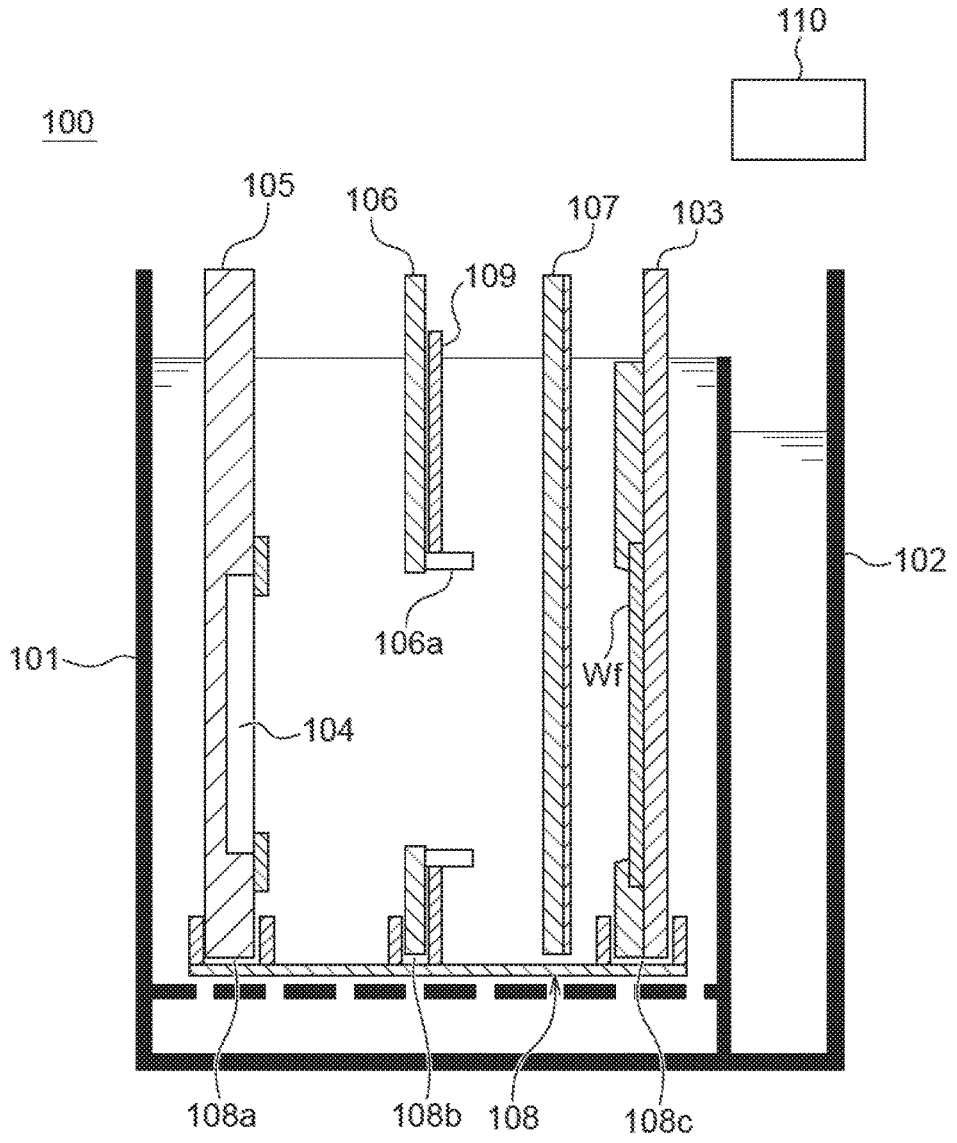
FIG. 1 is a schematic side cross-sectional view showing a plating apparatus adjusted by a method of adjusting the plating apparatus according to the embodiment.

Hereinafter, an embodiment of the present invention will be explained with reference to drawings. In the drawings explained hereinafter, the same symbol is attached to the same or the corresponding component, and overlapping explanation thereof is omitted.

FIG. 1 is a schematic side cross-sectional view showing a plating apparatus adjusted by a method of adjusting the plating apparatus according to the embodiment. As shown in FIG. 1, a plating apparatus 100 has: a plating bath 101 that stores plating liquid; and an overflow bath 102 that receives the plating liquid overflowing from the plating bath 101. In addition, the plating apparatus 100 has: a substrate holder 103 that holds a substrate Wf; an anode holder 105 that holds an anode 104; and a regulation plate 106 (it corresponds to one example of an electric field adjusting plate) for adjusting an electric field applied from the anode 104 to the substrate Wf.

The regulation plate 106 has an opening part 106*a* through which the electric field passes. The substrate Wf and the anode 104 are arranged in the plating bath 101 so as to be opposed to each other. In addition, the regulation plate 106 is arranged in the plating bath 101 so that the opening part 106*a* is located between the substrate Wf and the anode 104. A paddle 107 for stirring the plating liquid is provided between the substrate Wf and the regulation plate 106.

The substrate holder 103, the anode holder 105, the regulation plate 106, and the paddle 107 are hung in the plating bath 101. The plating bath 101 has a lower end limiting part 108 for limiting movement of lower ends of the substrate holder 103, the anode holder 105, and the regulation plate 106. The lower end limiting part 108 has: a slit 108*a* in which the lower end of the anode holder 105 is inserted; a slit 108*b* in which the lower end of the regulation plate 106 is inserted; and a slit 108*c* in which the lower end of the substrate holder 103 is inserted. The slits 108*a*, 108*b*, and 108*c* are formed to be wider than thicknesses of the anode holder 105, the regulation plate 106, and the substrate holder 103 so as not to completely fix the lower ends thereof.

The plating bath 101 has a partition plate 109 for blocking paths through which the electric field can pass, the paths being other than the opening part 106*a* of the regulation plate 106. The partition plate 109 has an opening part with a larger diameter than the opening part 106*a*. The regulation plate 106 is arranged in the plating bath 101 so that a side surface thereof is in close contact with a side surface of the partition plate 109. The electric field applied from the anode 104 to the substrate Wf passes through only the opening part 106*a* of the regulation plate 106 and the opening part of the partition plate 109.

In addition, the plating apparatus 100 has a data processing device 110 communicatively connected to a first laser sensor 14, a second laser sensor 15, distance sensors 16*a*, 16*b*, 16*c*, and 16*d*, and distance sensors 17*a* and 17*b* that are provided at a substrate holder jig 10 (refer to FIG. 2), a plate jig 30 (refer to FIG. 15), or an anode holder jig 50 (refer to FIG. 16), which will be mentioned later. The data processing device 110 is configured to be able to record measurement data obtained by the first laser sensor 14, the second laser sensor 15, the distance sensors 16*a*, 16*b*, 16*c*, and 16*d*, and the distance sensors 17*a* and 17*b*.

The method of adjusting the plating apparatus according to the embodiment, which will be explained hereinafter, is a method of adjusting positions (a position) of the substrate holder 103, the anode holder 105, the regulation plate 106, and/or the paddle 107 shown in FIG. 1. Specifically, according to the above-described method of adjusting the plating apparatus, the positions are respectively adjusted so that a center of the substrate Wf, a center of the anode 104, and a center of the opening part 106*a* of the regulation plate 106 are located on the same straight line, and so that the substrate Wf, the anode 104, and the regulation plate 106 are in parallel to each other. Note that the plating apparatus shown in FIG. 1 has a configuration in which the substrate holder 103, the anode holder 105, and the regulation plate 106 are arranged in the plating bath 101 in a vertical direction. However, with the method of adjusting the plating apparatus according to the embodiment, a plating apparatus can also be adjusted in which the substrate holder 103, the anode holder 105, and the regulation plate 106 are arranged in the plating bath 101 in a horizontal direction.

In the method of adjusting the plating apparatus according to the embodiment, there are used a substrate holder jig (it corresponds to one example of a first jig) formed by copying a shape of the substrate holder 103, an anode holder jig (it corresponds to one example of a second jig) formed by copying a shape of the anode holder 105, and a plate jig (it corresponds to one example of the second jig) formed by copying a shape of the regulation plate 106. First, a detailed configuration of each jig will be explained.

Figure 2:
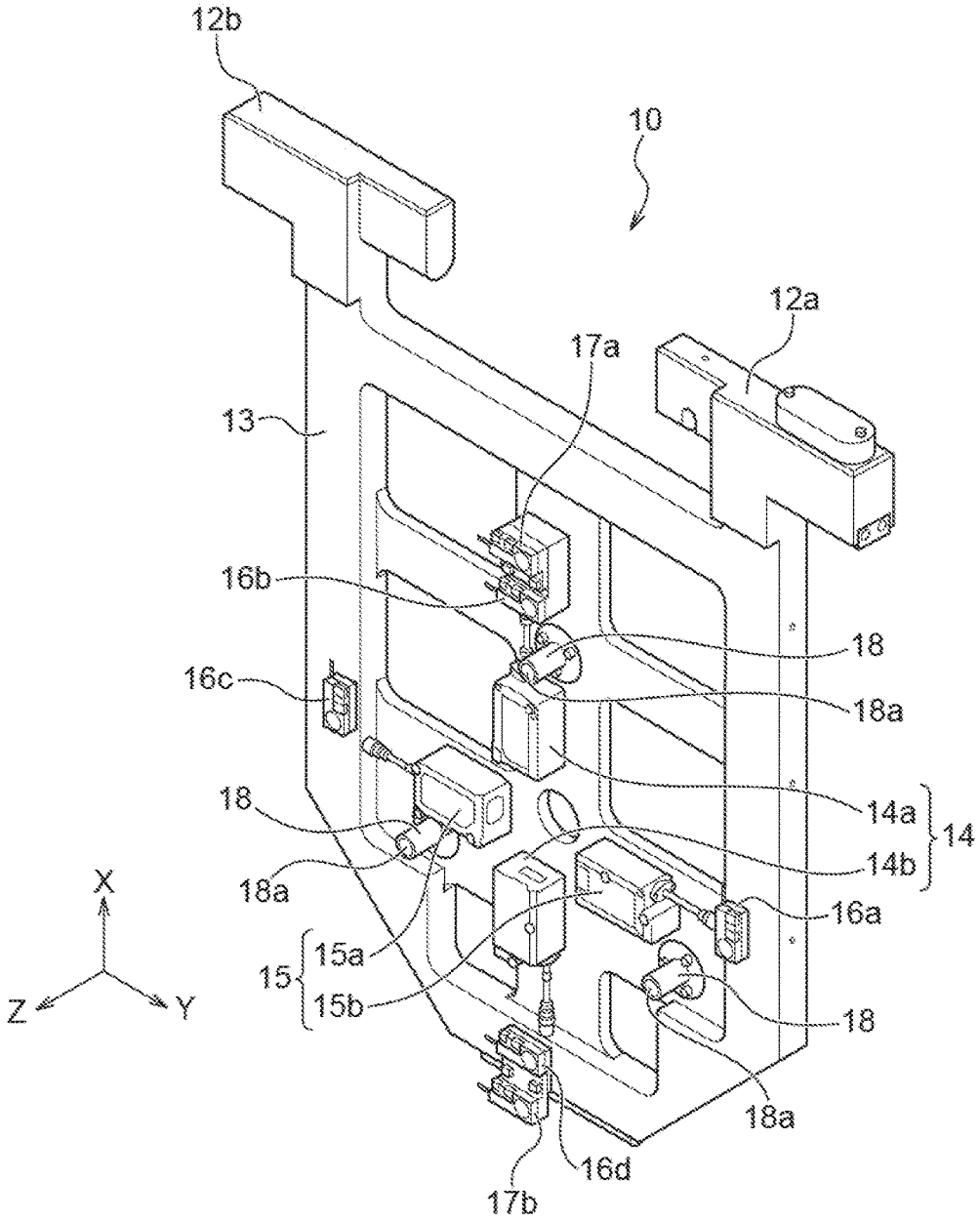
FIG. 2 is a perspective view of a substrate holder jig.

FIG. 2 is a perspective view of the substrate holder jig 10. X, Y, and Z-axes are appended in FIG. 2 in order to explain a direction of the substrate holder jig 10. In explaining the direction hereinafter, the X, Y, and Z-axes may be used. Note that the X-axis coincides with the vertical direction in the plating apparatus shown in FIG. 1. The Z-axis coincides with a normal direction of a surface of the substrate Wf in the plating apparatus shown in FIG. 1. In addition, a direction in an X-Y flat surface coincides with an in-plane direction of the substrate Wf.

The substrate holder jig 10 is installed at a position in the plating bath 101 shown in FIG. 1 where the substrate holder 103 is installed. For this reason, the substrate holder jig 10 has a pair of substantially T-shaped hanging parts 12*a* and 12*b*. The hanging parts 12*a* and 12*b* are hooked on edges of an opening part of the plating bath 101 shown in FIG. 1. In addition, the substrate holder jig 10 has a plate-shaped part 13 formed integrally with the hanging parts 12*a* and 12*b*. The substrate holder jig 10 has a shape similar to the substrate holder 103 as a whole by the hanging parts 12*a* and 12*b* and the plate-shaped part 13.

The substrate holder jig 10 is configured to have substantially the same weight as the substrate holder 103 including the substrate Wf. Hereby, the substrate holder jig 10 can be hung in the plating bath 101 shown in FIG. 1 on substantially the same conditions as the substrate holder 103. In addition, the substrate holder jig 10 is formed of metal, such as aluminum or stainless steel.

The substrate holder jig 10 has: the first laser sensor 14 (it corresponds to one example of a sensor and a position measuring sensor); and the second laser sensor 15 (it corresponds to one example of the sensor and the position measuring sensor). The first laser sensor 14 and the second laser sensor 15 are provided at a surface of the plate-shaped part 13, the surface being opposed to the anode holder jig or the plate jig. The first laser sensor 14 includes: a first light projecting part 14*a* that emits a laser with a predetermined width; and a first light receiving part 14*b* that receives the laser from the first light projecting part 14*a*. The first light projecting part 14*a* is arranged so as to be able to emit the laser toward an X-axis negative direction in FIG. 2. The first laser sensor 14 can measure how long the laser is blocked in a width direction by an object present between the first light projecting part 14*a* and the first light receiving part 14*b*. Accordingly, the first laser sensor 14 can measure a position of the object present between the first light projecting part 14*a* and the first light receiving part 14*b* in a Y-axis direction in FIG. 2.

The second laser sensor 15 includes: a second light projecting part 15*a* that emits a laser with a predetermined width; and a second light receiving part 15*b* that receives the laser from the second light projecting part 15*a*. The second light projecting part 15*a* is arranged so as to be able to emit the laser toward a Y-axis positive direction in FIG. 2. The second laser sensor 15 can detect how long the laser is blocked in a width direction by the object present between the second light projecting part 15*a* and the second light receiving part 15*b*. Accordingly, the second laser sensor 15 can measure a position of the object present between the second light projecting part 15*a* and the second light receiving part 15*b* in an X-axis direction in FIG. 2.

The laser emitted by the first light projecting part 14*a*, and the laser emitted by the second light projecting part 15*a* are perpendicular to each other. The first laser sensor 14 and the second laser sensor 15 are provided at the substrate holder jig 10 so that the perpendicular portion corresponds to substantially a center portion of the substrate Wf held by the substrate holder 103. Accordingly, the first laser sensor 14 and the second laser sensor 15 can measure a position of the object located between the first light projecting part 14*a* and the first light receiving part 14*b*, and between the second light projecting part 15*a* and the second light receiving part 15*b*, the position being in an in-plane direction of the substrate holder jig 10.

The substrate holder jig 10 further has the four distance sensors 16*a*, 16*b*, 16*c*, and 16*d* (they each correspond to one example of the sensor and a distance measuring sensor). The distance sensors 16*a*, 16*b*, 16*c*, and 16*d* can measure distances from the anode holder jig or the plate jig opposed to the substrate holder jig 10, respectively.

The distance sensors 16*b* and 16*d* are provided at respective positions of upper and lower parts of the plate-shaped part 13 of the substrate holder jig 10. The distance sensors 16*b* and 16*d* measure the distances from the anode holder jig or the plate jig, respectively, and thereby a distance and an inclination around the Y-axis of the anode holder jig or the plate jig with respect to the substrate holder jig 10 can be measured.

The distance sensors 16*a* and 16*c* are provided at respective positions of right and left sides of the plate-shaped part 13 of the substrate holder jig 10. The distance sensors 16*a* and 16*c* measure the distances from the anode holder jig or the plate jig, respectively, and thereby a distance and an inclination around the X-axis of the anode holder jig or the plate jig with respect to the substrate holder jig 10 can be measured.

Note that although the substrate holder jig 10 has the four distance sensors 16*a*, 16*b*, 16*c*, and 16*d* in the embodiment, the present invention is not limited to this. The substrate holder jig 10 may just have at least three distance sensors in order to measure the inclination and the distance of the anode holder jig or the plate jig with respect to the substrate holder jig 10. A reason to need at least the three distance sensors is that mathematically, a unique flat surface is determined by positions of three points not located on a straight line. Therefore, at least the three distance sensors are not arranged on a straight line.

The substrate holder jig 10 further has the two distance sensors 17*a* and 17*b*. The distance sensors 17*a* and 17*b* can measure distances from the paddle 107 (refer to FIG. 1) opposed to the substrate holder jig 10. The distance sensors 17*a* and 17*b* are provided at respective positions of upper and lower parts of the plate-shaped part 13 of the substrate holder jig 10. Accordingly, the distance sensors 17*a* and 17*b* measure the distances from the paddle 107, respectively, and thereby a distance and an inclination around the Y-axis of the paddle 107 with respect to the substrate holder jig 10 can be measured.

The substrate holder jig 10 has three cylindrical members 18. The three cylindrical members 18 are provided at predetermined positions (they each correspond to one example of an angle measuring reference position) of the plate-shaped part 13 of the substrate holder jig 10, respectively. Each cylindrical member 18 includes a hole 18*a* (it corresponds to one example of an angle measuring hole) opened in a normal direction (a Z-axis direction) of the substrate holder jig 10. A diameter of the hole 18*a* is designed to be slightly larger than that of a pin 37 (refer to FIG. 3), which will be mentioned later. Note that the cylindrical member 18 is attached to the substrate holder jig 10 so that a position thereof can be adjusted within a predetermined range.

The first laser sensor 14, the second laser sensor 15, the distance sensors 16*a*, 16*b*, 16*c*, and 16*d*, and the distance sensors 17*a* and 17*b* are communicatively connected to the data processing device 110 shown in FIG. 1 through a not-shown wiring or by wireless. The measurement data obtained by the first laser sensor 14, the second laser sensor 15, the distance sensors 16*a*, 16*b*, 16*c*, and 16*d*, and the distance sensors 17*a* and 17*b* is transmitted to the data processing device 110.

Figure 3:
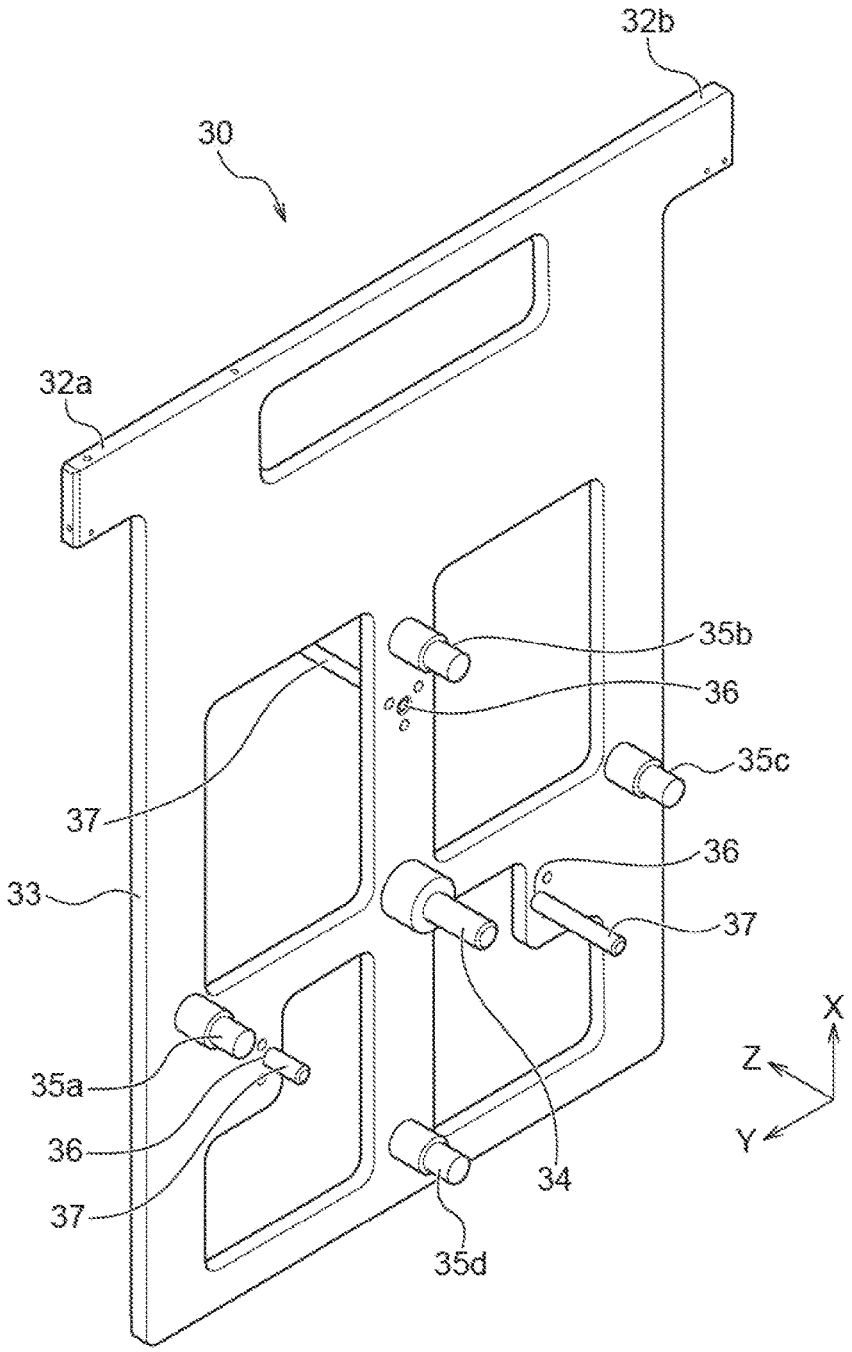
FIG. 3 is a perspective view of a plate jig.

FIG. 3 is a perspective view of the plate jig 30. X, Y, and Z-axes are appended in FIG. 3 in order to explain a direction of the plate jig 30. In explaining the direction hereinafter, the X, Y, and Z-axes may be used. Note that the X, Y, and Z-axes in FIG. 3 coincide with those shown in FIG. 2.

The plate jig 30 is installed at a position in the plating bath 101 shown in FIG. 1 where the regulation plate 106 is installed. For this reason, the plate jig 30 has a pair of hanging parts 32*a* and 32*b*. The hanging parts 32*a* and 32*b* are hooked on edges of the opening part of the plating bath 101 shown in FIG. 1. In addition, the plate jig 30 has a plate-shaped part 33 formed integrally with the hanging parts 32*a* and 32*b*. The plate jig 30 has a shape similar to the regulation plate 106 as a whole by the hanging parts 32*a* and 32*b* and the plate-shaped part 33.

The plate jig 30 is configured to have substantially the same weight as the regulation plate 106. Hereby, the plate jig 30 can be hung in the plating bath 101 shown in FIG. 1 on substantially the same conditions as the regulation plate 106. In addition, the plate jig 30 is, for example, formed of metal, such as aluminum or stainless steel.

The plate jig 30 has a center pin 34 (it corresponds to one example of a position measuring member and a position measuring pin) in substantially a center portion of the plate-shaped part 33. The center pin 34 is configured removably from the plate-shaped part 33. The center pin 34 is provided at a surface of the plate-shaped part 33 opposed to the substrate holder jig 10 (refer to FIG. 2). Accordingly, when the substrate holder jig 10 and the plate jig 30 are housed in the plating bath 101 shown in FIG. 1, the center pin 34 protrudes toward the substrate holder jig 10. The center pin 34 is designed to have a length with which the center pin 34 can block a part of the laser emitted by the first light projecting part 14*a* and a part of the laser emitted by the second light projecting part 15*a* of the substrate holder jig 10, when the substrate holder jig 10 and the plate jig 30 are housed in the plating bath 101 shown in FIG. 1. The center pin 34 is, for example, formed of metal, such as aluminum or stainless steel.

The plate jig 30 further has four outer peripheral pins 35*a*, 35*b*, 35*c*, and 35*d* (they each correspond to one example of a distance measuring member and a distance measuring pin). The outer peripheral pins 35*a*, 35*b*, 35*c*, and 35*d* are configured removably from the plate-shaped part 33. The outer peripheral pins 35*b* and 35*d* are provided at respective positions of upper and lower parts of the plate-shaped part 33. Specifically, the outer peripheral pins 35*b* and 35*d* are arranged at the positions that can be detected by the distance sensors 16*b* and 16*d* of the substrate holder jig 10. The outer peripheral pins 35*a* and 35*c* are provided at respective positions of right and left sides of the plate-shaped part 33. Specifically, the outer peripheral pins 35*a* and 35*c* are arranged at the positions that can be detected by the distance sensors 16*a* and 16*c* of the substrate holder jig 10. Namely, distances from the distance sensors 16*a*, 16*b*, 16*c*, and 16*d* to the outer peripheral pins 35*a*, 35*b*, 35*c*, and 35*d* are measured by the distance sensors 16*a*, 16*b*, 16*c*, and 16*d* of the substrate holder jig 10.

Note that although the plate jig 30 has the four outer peripheral pins 35*a*, 35*b*, 35*c*, and 35*d* in the embodiment, the present invention is not limited to this. The plate jig 30 may just have at least three outer peripheral pins in order to measure an inclination and a distance of the plate jig 30 with respect to the substrate holder jig 10.

The plate jig 30 further has three holes 36 (they each correspond to one example of an angle measuring hole). The three holes 36 are provided at predetermined positions (they each correspond to one example of an angle measuring reference position) of the plate-shaped part 33 of the plate jig 30, respectively. A diameter of the hole 36 is designed to be slightly larger than that of the pin 37.

Figure 4:
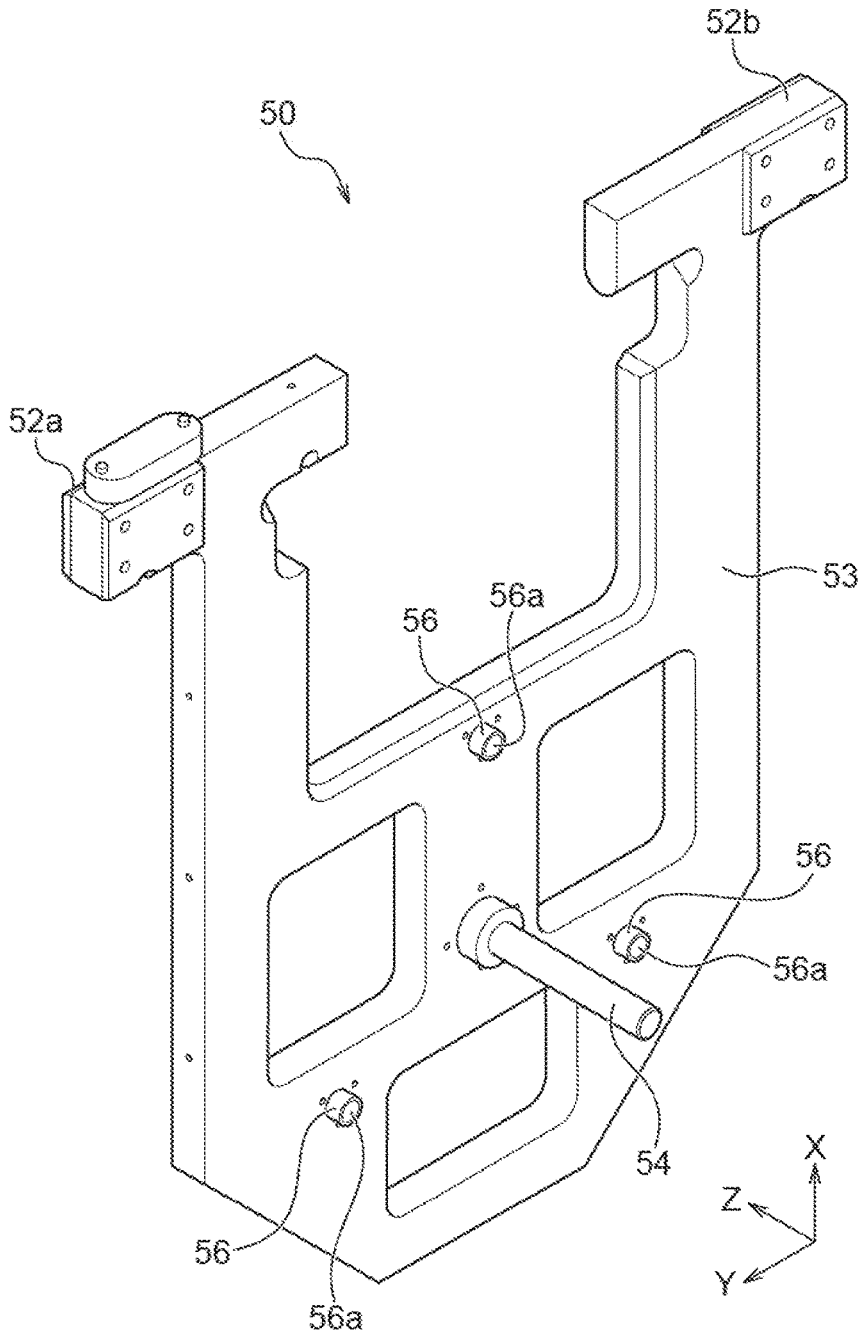
FIG. 4 is a perspective view of an anode holder jig.

FIG. 4 is a perspective view of the anode holder jig 50. X, Y, and Z-axes are appended in FIG. 4 in order to explain a direction of the anode holder jig 50. In explaining the direction hereinafter, the X, Y, and Z-axes may be used. Note that the X, Y, and Z-axes in FIG. 4 coincide with those shown in FIGS. 2 and 3.

The anode holder jig 50 is installed at a position in the plating bath 101 shown in FIG. 1 where the anode holder 105 is installed. For this reason, the anode holder jig 50 has a pair of hanging parts 52*a* and 52*b*. The hanging parts 52*a* and 52*b* are hooked on edges of the opening part of the plating bath 101 shown in FIG. 1. In addition, the anode holder jig 50 has a plate-shaped part 53 formed integrally with the hanging parts 52*a* and 52*b*. The anode holder jig 50 has a shape similar to the anode holder 105 as a whole by the hanging parts 52*a* and 52*b* and the plate-shaped part 53.

The anode holder jig 50 is configured to have substantially the same weight as the anode holder 105. Hereby, the anode holder jig 50 can be hung in the plating bath 101 shown in FIG. 1 on substantially the same conditions as the anode holder 105. In addition, the anode holder jig 50 is, for example, formed of metal, such as aluminum or stainless steel.

The anode holder jig 50 has a center pin 54 (it corresponds to one example of a position measuring member and a position measuring pin) in substantially a center portion of the plate-shaped part 53. The center pin 54 is configured removably from the plate-shaped part 53. The center pin 54 is provided at a surface of the plate-shaped part 53 opposed to the substrate holder jig 10 (FIG. 2). Accordingly, when the substrate holder jig 10 and the anode holder jig 50 are housed in the plating bath 101 shown in FIG. 1, the center pin 54 protrudes toward the substrate holder jig 10. The center pin 54 is designed to have a length with which the center pin 54 can block a part of the laser emitted by the first light projecting part 14*a* and a part of the laser emitted by the second light projecting part 15*a* of the substrate holder jig 10, when the substrate holder jig 10 and the anode holder jig 50 are housed in the plating bath 101 shown in FIG. 1. The center pin 54 is, for example, formed of metal, such as aluminum or stainless steel.

The anode holder jig 50 has three cylindrical members 56. The three cylindrical members 56 are provided at predetermined positions (they each correspond to one example of an angle measuring reference position) of the plate-shaped part 53 of the anode holder jig 50, respectively. Each cylindrical member 56 includes a hole 56*a* (it corresponds to one example of an angle measuring hole) opened in a normal direction (a Z-axis direction) of the anode holder jig 50. A diameter of the hole 56*a* is designed to be slightly larger than that of the pin 37 shown in FIG. 2. Note that the cylindrical member 56 is attached to the anode holder jig 50 so that a position thereof can be adjusted within a predetermined range.

Subsequently, there will be explained the method of adjusting the plating apparatus according to the embodiment using each jig shown in FIGS. 2 to 4. First, the substrate holder jig 10, and the plate jig 30 or the anode holder jig 50 are arranged so as to have a desired positional relation. In this state, a position (a reference position) of the plate jig 30 or the anode holder jig 50 with respect to the substrate holder jig 10 is measured by the first laser sensor 14 and the second laser sensor 15, and the distance sensors 16*a*, 16*b*, 16*c*, and 16*d* of the substrate holder jig 10. At this time, measurement data of the reference position obtained by the first laser sensor 14 and the second laser sensor 15, and the distance sensors 16*a*, 16*b*, 16*c*, and 16*d* is recorded in the data processing device 110 shown in FIG. 1. Note that a "positional relation" in the specification means a relation of position, inclination (degree of parallelism), or distance between any two jigs of the substrate holder jig 10, the plate jig 30, and the anode holder jigs 50 in an in-plane direction.

In the method of adjusting the plating apparatus according to the embodiment, an installation position of the substrate holder 103 and an installation position of the regulation plate 106 are adjusted so that the substrate holder jig 10 and the plate jig 30 are housed in the plating bath 101 shown in FIG. 1 in the desired positional relation. The above-described desired positional relation is determined so that the center of the substrate Wf and the center of the opening part 106*a* of the regulation plate 106 are aligned on substantially the same straight line, and so that the substrate Wf and the regulation plate 106 are separated from each other by a predetermined distance and are located substantially in parallel to each other, when the substrate holder 103 and the regulation plate 106 are installed at the installation positions.

Similarly, in the method of adjusting the plating apparatus according to the embodiment, the installation position of the substrate holder 103 and an installation position of the anode holder 105 are adjusted so that the substrate holder jig 10 and the anode holder jig 50 are housed in the plating bath 101 shown in FIG. 1 in the desired positional relation. The above-described desired positional relation is determined so that the center of the substrate Wf and the center of the anode 104 are aligned on substantially the same straight line, and so that the substrate Wf and the anode 104 are separated from each other by a predetermined distance and are located substantially in parallel to each other, when the substrate holder 103 and the anode holder 105 are installed at the installation positions.

<Measurement of Reference Position>

Figure 5:
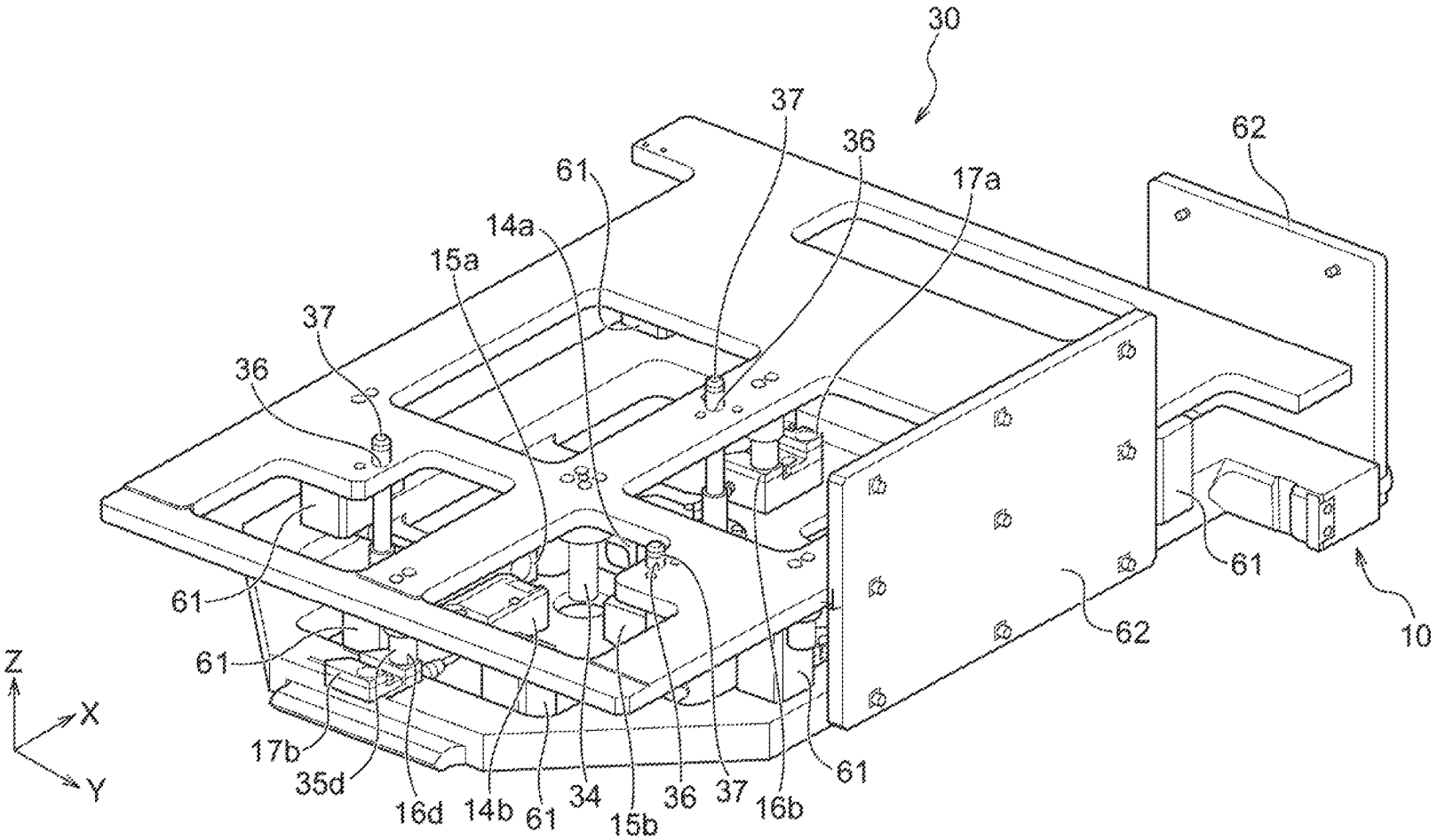
FIG. 5 is a perspective view showing the substrate holder jig and the plate jig arranged so as to have a desired positional relation.

FIG. 5 is a perspective view showing the substrate holder jig 10 and the plate jig 30 arranged so as to have a desired positional relation. X, Y, and Z-axes in FIG. 5 coincide with those shown in FIGS. 2 to 4. As shown in FIG. 5, the substrate holder jig 10 is horizontally arranged. A plurality of blocks 61 (they each correspond to one example of a distance holding member) each having a substantially rectangular parallelepiped shape are arranged on an upper surface of the substrate holder jig 10. The plate jig 30 is horizontally arranged on upper surfaces of the blocks 61. The blocks 61 hold a constant distance between the substrate holder jig 10 and the plate jig 30. Hereby, the substrate holder jig 10 and the plate jig 30 are located substantially in parallel to each other.

A plurality of reference plates 62 are attached to side surfaces of the substrate holder jig 10. In the embodiment, the two reference plates 62 are attached to the side surfaces of the substrate holder jig 10 so as to face a direction in which they are perpendicular to each other. The plate jig 30 is arranged on the upper surfaces of the blocks 61 so that side surfaces of the plate jig 30 abut against the reference plates 62. Accordingly, the plate jig 30 is arranged on the upper surfaces of the blocks 61 so that side surface positions of the plate jig 30 coincide with those of the substrate holder jig 10.

The substrate holder jig 10, the plate jig 30, the blocks 61, and the reference plates 62 are designed so that a state where the distance between the substrate holder jig 10 and the plate jig 30, and the side surface positions thereof are held by the blocks 61 and the reference plates 62 serves as a desired positional relation.

Figure 6:
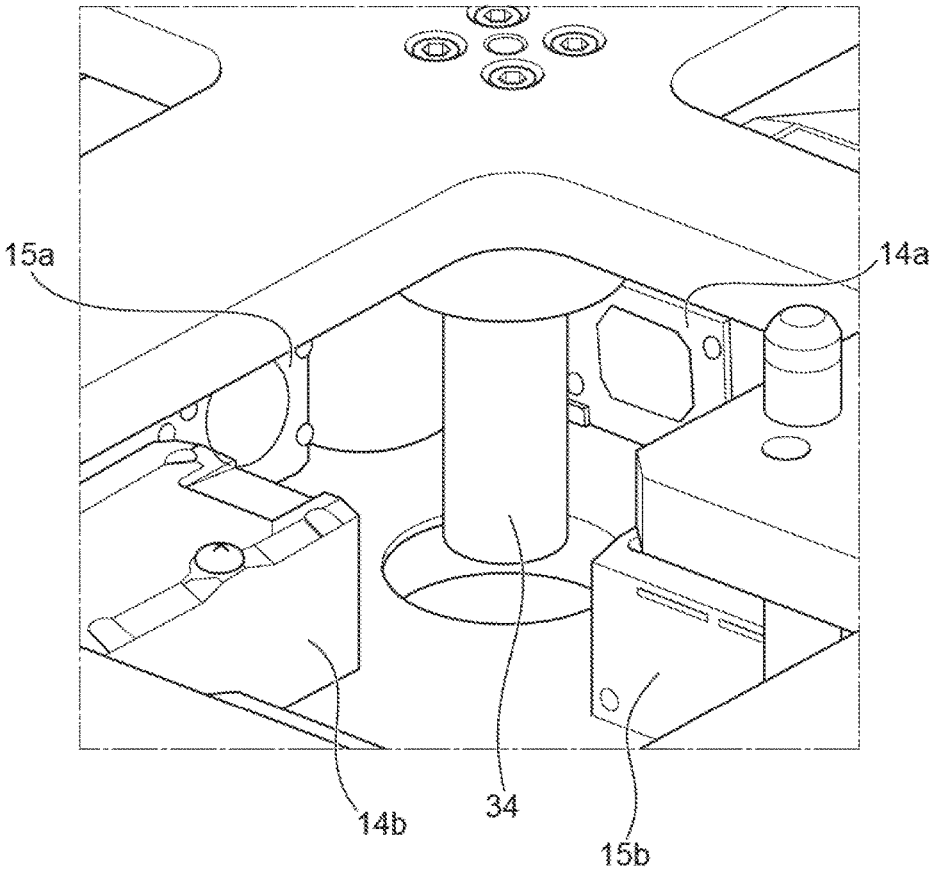
FIG. 6 is an enlarged view of a first laser sensor, a second laser sensor, and a center pin shown in FIG. 5.

FIG. 6 is an enlarged view of the first laser sensor 14, the second laser sensor 15, and the center pin 34 shown in FIG. 5. As shown in FIG. 6, a tip of the center pin 34 of the plate jig 30 is located between the first light projecting part 14*a* and the first light receiving part 14*b* of the first laser sensor 14, and between the second light projecting part 15*a* and the second light receiving part 15*b* of the second laser sensor 15.

Figure 7:
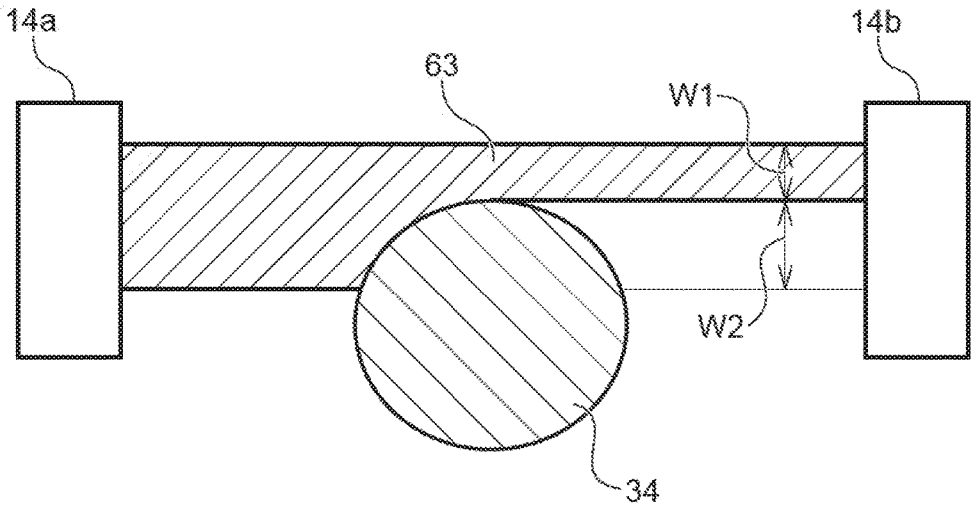
FIG. 7 is a schematic view showing a laser radiated by a first light projecting part, and the center pin.
Figure 8:
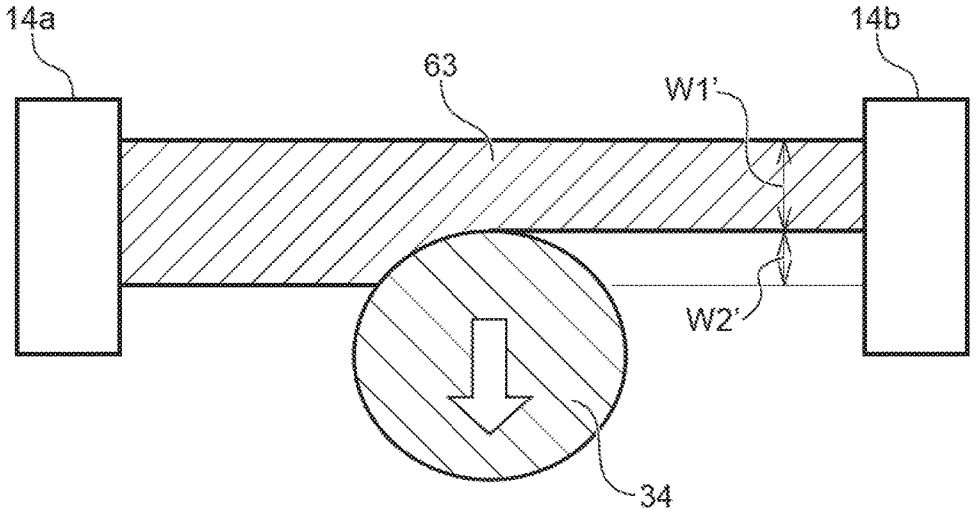
FIG. 8 is a schematic view showing the laser radiated by the first light projecting part, and the center pin.

FIGS. 7 and 8 are schematic views showing a laser radiated by the first light projecting part 14*a*, and the center pin 34. As shown in FIG. 7, a part of a laser light 63 radiated from the first light projecting part 14*a* is blocked or cut-off, by the center pin 34, the part of the laser light 63 having a width W2, and a remaining part thereof having a width W1 enters the first light receiving part 14*b*.

The first laser sensor 14 is configured to be able to numerically display a value of the width W1. In the positional relation between the substrate holder jig 10 and the plate jig 30 shown in FIG. 5, the first light receiving part 14*b*, for example, receives the above-described remaining part of the laser light 63 having the width W1. Here, the first laser sensor 14 may perform zero calibration of the above-described value of the width W1. Hereby, the position of the center pin 34 shown in FIG. 7 serves as a reference position. A value (it is zero in a case where zero calibration is performed) of the reference position is recorded in the data processing device 110 shown in FIG. 1.

In a case where the position of the center pin 34 with respect to the first light projecting part 14*a* and the first light receiving part 14*b* is changed, the center pin 34 blocks a part of the laser light 63 having a width W2' different from the width W2 as shown in FIG. 8. Accordingly, the first light receiving part 14*b* receives a remaining part of the laser light 63 having a width W1'. A value of the width W1' is recorded in the data processing device 110 shown in FIG. 1. The data processing device 110 calculates a comparison value of measurement data (the value of the width W1) already recorded as the reference position, and newly obtained measurement data (the value of the width W1'). Specifically, the comparison value is W1'−W1. In a case where the first laser sensor 14 performs zero calibration in a state shown in FIG. 7, a change amount (W1'−W1) of a width of the received laser light is the value of the width W1', and the data processing device 110 can display the comparison value. In a manner as described above, the first laser sensor 14 can measure an amount of movement of the center pin 34 in the Y-axis direction (refer to FIG. 5) with respect to the reference position. In other words, the first laser sensor 14 can measure a distance in the Y-axis direction from the reference position to the center pin 34.

Similarly to a principle in which the first laser sensor 14 measures the amount of movement of the center pin 34 in the Y-axis direction, the second laser sensor 15 can measure a distance in the X-axis direction from the reference position to the center pin 34.

According to such a manner as described above, the distances in the Y-axis direction and the X-axis direction from the reference position to the center pin 34 can be measured by the first laser sensor 14 and the second laser sensor 15. Accordingly, the first laser sensor 14 and the second laser sensor 15 can measure a distance in an X-Y flat surface (it corresponds to an in-plane direction of a surface of the substrate holder jig 10, the surface being opposed to the plate jig 30 or the anode holder jig 50) from the reference position to the center pin 34.

Figure 9:
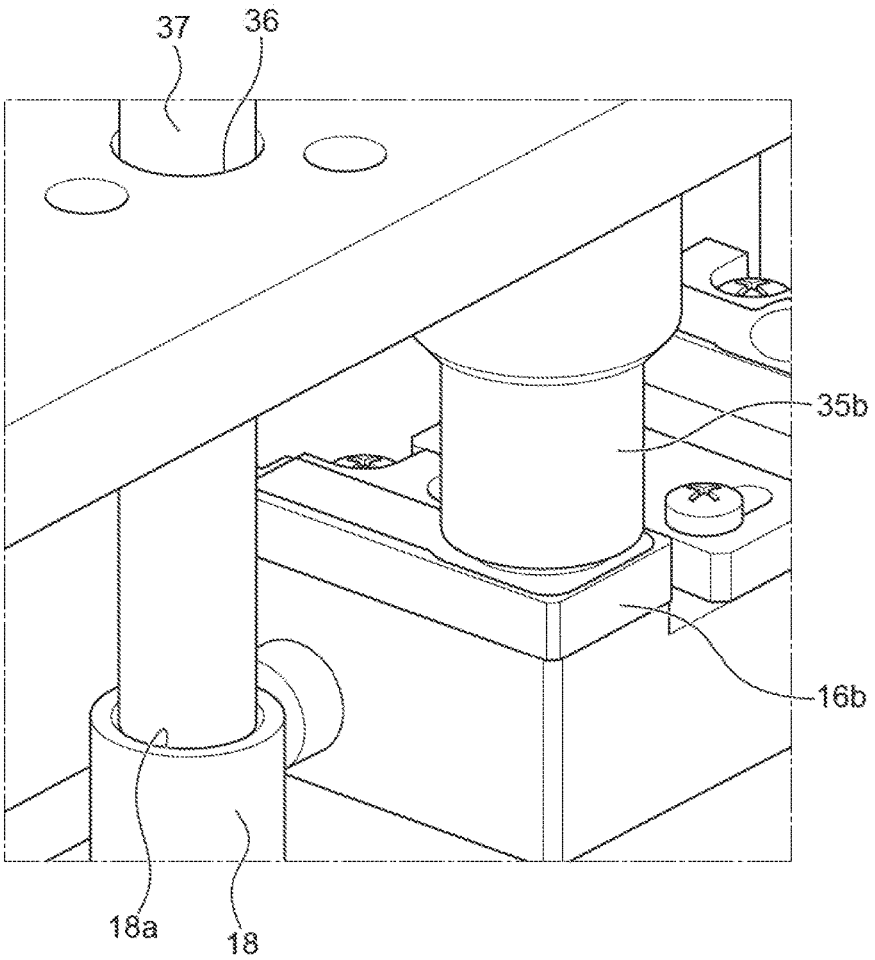
FIG. 9 is an enlarged view of an outer peripheral pin, a distance sensor, a hole, and a hole shown in FIG. 5.

FIG. 9 is an enlarged view of the outer peripheral pin 35*b*, the distance sensor 16*b*, the hole 36, and the hole 18*a* shown in FIG. 5. As shown in FIG. 9, the outer peripheral pin 35*b* is located close to the distance sensor 16*b*. The distance sensor 16*b* can measure a distance from the distance sensor 16*b* to the outer peripheral pin 35*b*. The distance sensors 16*a*, 16*c*, and 16*d* that are not shown in FIG. 9 can measure distances to the outer peripheral pins 35*a*, 35*c*, and 35*d*, respectively. Since the substrate holder jig 10 and the plate jig 30 that are shown in FIG. 5 are located substantially in parallel to each other, the distance sensors 16*a*, 16*b*, 16*c*, and 16*d* measure substantially the same distances. In this state, the distance sensors 16*a*, 16*b*, 16*c*, and 16*d* may perform zero calibration of the distances to the outer peripheral pins 35*a*, 35*b*, 35*c*, and 35*d*. Values (they are zero in a case where zero calibration is performed) of the distances are recorded in the data processing device 110 shown in FIG. 1. When positions of the outer peripheral pins 35*a*, 35*b*, 35*c*, and 35*d* are changed, the distances measured by the distance sensors 16*a*, 16*b*, 16*c*, and 16*d* are changed. Values of the changed distances are recorded in the data processing device 110 shown in FIG. 1. The data processing device 110 calculates a comparison value of measurement data (it is zero in a case where zero calibration is performed) already recorded as a reference position, and a value (newly obtained measurement data) of the changed distance. The data processing device 110 can display the comparison value. Hereby, the distance sensors 16*a*, 16*b*, 16*c*, and 16*d* can measure change amounts of the positions of the outer peripheral pins 35*a*, 35*b*, 35*c*, and 35*d* from a state shown in FIG. 5.

In addition, as shown in FIG. 9, the position of the cylindrical member 18 on the substrate holder jig 10 is adjusted so that the pin 37 penetrates the hole 36 of the plate jig 30 and the hole 18*a* of the substrate holder jig 10. Namely, the position of the cylindrical member 18 is adjusted so that the hole 36 and the hole 18*a* are coaxially located in the state shown in FIG. 5.

A method of measuring the reference position of the plate jig 30 with respect to the substrate holder jig 10 has been explained in FIGS. 5 to 9. With a method similar to this, a reference position of the anode holder jig 50 with respect to the substrate holder jig 10 can also be measured. Specifically, the anode holder jig 50 is arranged on the blocks 61 instead of the plate jig 30 shown in FIG. 5. At this time, side surfaces of the anode holder jig 50 are made to abut against the reference plates 62. A position of the center pin 54 of the anode holder jig 50 is measured by the first laser sensor 14 and the second laser sensor 15. Zero calibration of a value measured at this time may be performed. The measured value serves as a reference position of the center pin 54. The value (it is zero in a case where zero calibration is performed) of the reference position is recorded in the data processing device 110 shown in FIG. 1. In addition, it is confirmed that the pin 37 penetrates the hole 56*a* of the anode holder jig 50, and the hole 18*a* of the substrate holder jig 10. Note that in a case where a position of the hole 56*a* of the anode holder jig 50 is deviated from a position of the hole 18*a* of the substrate holder jig 10, a position of the cylindrical member 56 of the anode holder jig 50 is adjusted, and the positions of the hole 18*a* and the hole 56*a* are made to coincide with each other.

<Measurement of Positional Relation, and Adjustment of Plating Apparatus>

Figure 10:
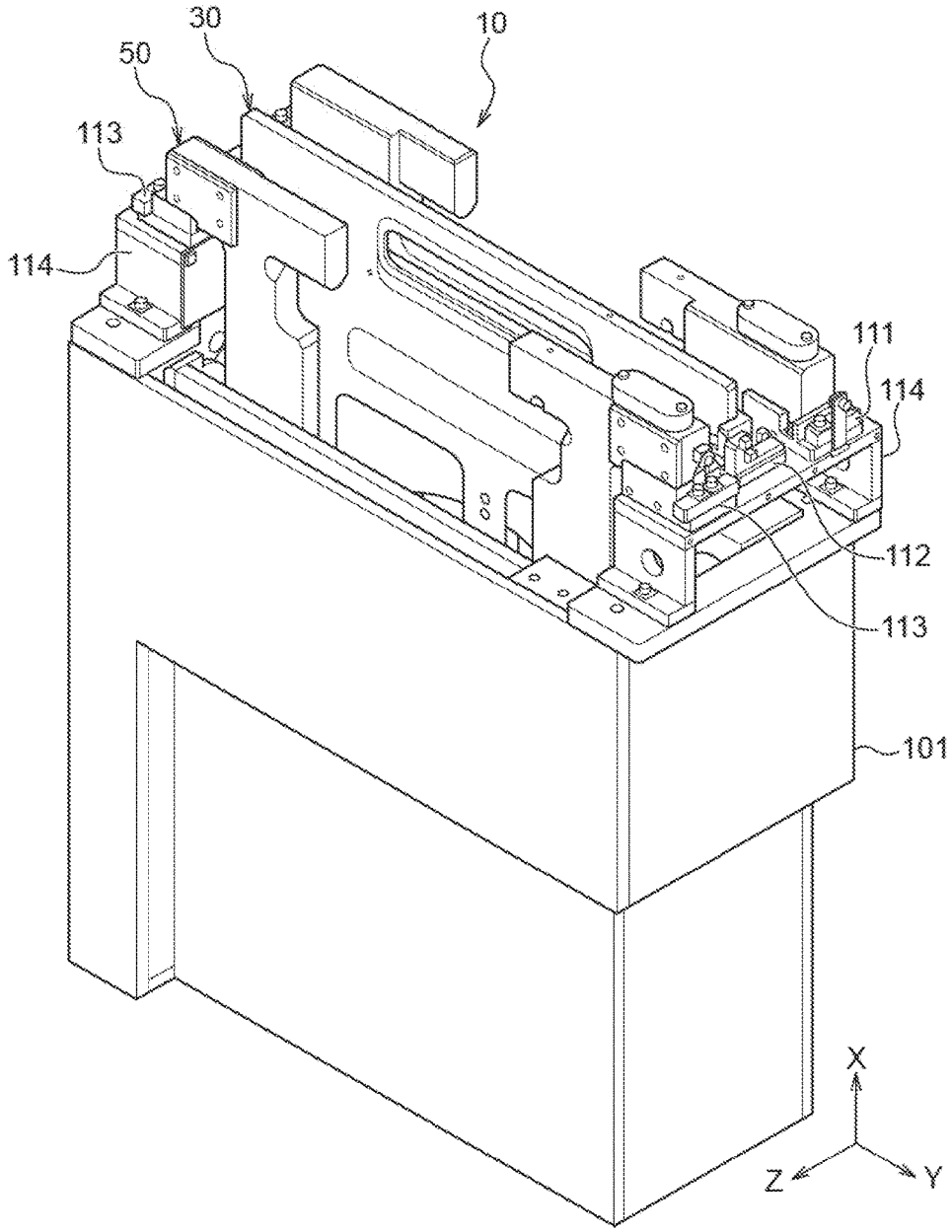
FIG. 10 is a perspective view showing the substrate holder jig, the plate jig, and the anode holder jig installed in a plating bath.

Next, there will be explained a method of measuring a mutual positional relation among the substrate holder jig 10, the plate jig 30, and the anode holder jig 50 installed in the plating bath 101 shown in FIG. 1. FIG. 10 is a perspective view showing the substrate holder jig 10, the plate jig 30, and the anode holder jig 50 installed in the plating bath 101. X, Y, and Z-axes in FIG. 10 coincide with those shown in FIGS. 2 to 5. As shown in FIG. 10, a pair of bases 114 is provided at edges of the opening part of the plating bath 101. A substrate holder support part 111, a plate support part 112, and an anode holder support part 113 are attached onto the bases 114, respectively. Only ones of the pair of substrate holder support parts 111 and the pair of plate support parts 112 are shown in FIG. 10. The substrate holder support part 111 is configured to support the substrate holder 103 or the substrate holder jig 10. The plate support part 112 is configured to support the regulation plate 106 or the plate jig 30. The anode holder support part 113 is configured to support the anode holder 105 or the anode holder jig 50.

The installation position of the substrate holder 103 can be adjusted by adjusting a position of the substrate holder support part 111 with respect to the base 114, which is the installation position of the substrate holder 103, or an angle thereof. The installation position of the regulation plate 106 can be adjusted by adjusting a position of the plate support part 112 with respect to the base 114, which is the installation position of the regulation plate 106, or an angle thereof. Similarly, the installation position of the anode holder 105 can be adjusted by adjusting a position of the anode holder support part 113 with respect to the base 114, which is the installation position of the anode holder 105, or an angle thereof.

Figure 11:
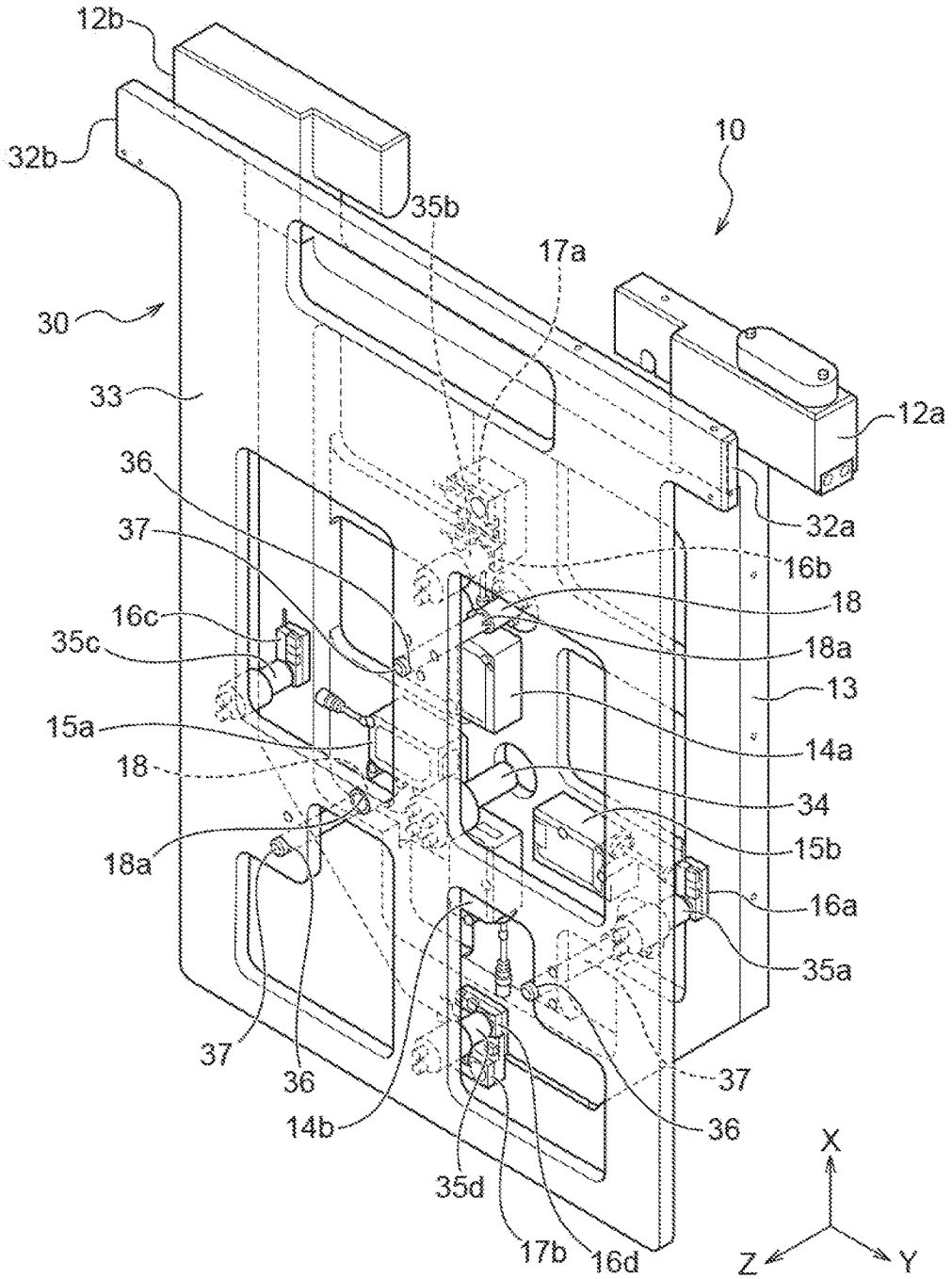
FIG. 11 is a perspective view showing the substrate holder jig and the plate jig in a state of being housed in the plating bath.

FIG. 11 is a perspective view showing the substrate holder jig 10 and the plate jig 30 in a state of being housed in the plating bath 101. The plating bath 101 is not shown in FIG. 11 for convenience. In addition, the plate jig 30 is shown to be transparent for convenience. As shown in FIG. 11, the tip of the center pin 34 of the plate jig 30 is located between the first light projecting part 14*a* and the first light receiving part 14*b* of the first laser sensor 14, and between the second light projecting part 15*a* and the second light receiving part 15*b* of the second laser sensor 15. In this state, a distance of the center pin 34 from a reference position in the X-Y flat surface is measured by the first laser sensor 14 and the second laser sensor 15. Specifically, data measured by the first laser sensor 14 and the second laser sensor 15 in a state shown in FIG. 11 is recorded in the data processing device 110 shown in FIG. 1. The data processing device 110 calculates a comparison value of the recorded data and the data measured by the first laser sensor 14 and the second laser sensor 15 in the state shown in FIG. 5. The comparison value indicates the distance of the center pin 34 from the reference position.

The position of the substrate holder support part 111 and/or the position of the plate support part 112 that are shown in FIG. 10 are adjusted based on the distance of the center pin 34 from the reference position in the X-Y flat surface, the distance being measured by the first laser sensor 14 and the second laser sensor 15. Namely, the position of the substrate holder support part 111 and/or the position of the plate support part 112 are adjusted so that the position of the center pin 34 in the X-Y flat surface, for example, falls within a range not less than −0.2 mm and not more than 0.2 mm with respect to the reference position. Specifically, for example, the position of the substrate holder support part 111 is made to be high by inserting a spacer between the base 114 and the substrate holder support part 111. In addition, for example, the substrate holder support part 111 is moved in the Y-axis direction with respect to the base 114. Hereby, installation positions (an installation position) of the substrate holder 103 and/or the plate support part 112 in the in-plane direction of the substrate Wf can be adjusted.

In addition, as shown in FIG. 11, the outer peripheral pins 35*a*, 35*b*, 35*c*, and 35*d* of the plate jig 30 are arranged close to the distance sensors 16*a*, 16*b*, 16*c*, and 16*d* of the substrate holder jig 10, respectively. In this state, distances from the distance sensors 16*a*, 16*b*, 16*c*, and 16*d* to the outer peripheral pins 35*a*, 35*b*, 35*c*, and 35*d* are measured by the distance sensors 16*a*, 16*b*, 16*c*, and 16*d*. Specifically, data measured by the distance sensors 16*a*, 16*b*, 16*c*, and 16*d* in the state shown in FIG. 11 is recorded in the data processing device 110 shown in FIG. 1. The data processing device 110 calculates a comparison value (in other word, a change amount) of the recorded data and the data measured by the distance sensors 16*a*, 16*b*, 16*c*, and 16*d* in the state shown in FIG. 5.

The position(s) or angles (an angle) of the substrate holder support part 111 and/or the plate support part 112 that are shown in FIG. 10 are (is) adjusted based on the above-described distances measured by the distance sensors 16*a*, 16*b*, 16*c*, and 16*d*. Specifically, the angle(s) of the substrate holder support part 111 and/or the plate support part 112 are (is) adjusted so that differences among four numerical values measured by the four distance sensors 16*a*, 16*b*, 16*c*, and 16*d*, respectively are, for example, not more than 0.3 mm. Hereby, the substrate holder support part 111 and/or the plate support part 112 are (is) adjusted so that the substrate holder 103 and the regulation plate 106 are in parallel to each other.

In addition, positions (a position) of the substrate holder support part 111 and/or the plate support part 112 in a horizontal direction are (is) adjusted so that the numerical values measured by the distance sensors 16*a*, 16*b*, 16*c*, and 16*d*, respectively become desired numerical values. Specifically, the position(s) of the substrate holder support part 111 and/or the plate support part 112 in the horizontal direction are (is) adjusted so that the comparison value calculated by the data processing device 110 shown in FIG. 1 approaches zero. Hereby, the substrate holder support part 111 and/or the plate support part 112 are (is) adjusted so that a distance between the substrate holder 103 and the regulation plate 106 becomes a desired one.

Note that in the embodiment, as shown in FIG. 1, the regulation plate 106 is arranged in the plating bath 101 so that the side surface of the regulation plate 106 is in close contact with the side surface of the partition plate 109. For this reason, the position and an angle (an inclination) of the plate support part 112 in the horizontal direction are not adjusted in the embodiment. In this case, the position and the angle of the plate support part 112 in the horizontal direction are fixed, and the position and the angle of the substrate holder support part 111 in the horizontal direction are adjusted.

As shown in FIG. 11, the pin 37 is inserted in the hole 36 of the plate jig 30, and the hole 18*a* of the substrate holder jig 10. Accordingly, rotation angles (rotation angles around the Z-axis) of the plate jig 30 and the substrate holder jig 10 shown in FIG. 11 in the X-Y flat surface are not deviated. In a case where the pin 37 cannot be inserted in the three holes 36 of the plate jig 30 and the three holes 18*a* of the substrate holder jig 10, the rotation angles of the substrate holder jig 10 and the plate jig 30 in the X-Y flat surface are deviated. In other words, presence/absence of the deviation of the rotation angles can be detected by inserting the pin 37 in the three holes 36 of the plate jig 30 and the three holes 18*a* of the substrate holder jig 10.

In a case where the above-described rotation angles are deviated, the position(s) or the angle(s) of the substrate holder support part 111 and/or the plate support part 112 are (is) adjusted so that the pin 37 can be inserted in the hole 36 of the plate jig 30 and the hole 18*a* of the substrate holder jig 10. Specifically, for example, the position of the one substrate holder support part 111 is made to be high by inserting a spacer between one of the pair of substrate holder support parts 111 and the base 114. Hereby, rotation angles of the substrate holder 103 and the regulation plate 106 in the X-Y flat surface are adjusted.

As shown in FIG. 11, the position of the substrate holder support part 111, which is the installation position of the substrate holder 103, and the position of the plate support part 112, which is the installation position of the regulation plate 106, are adjusted. Subsequently, the installation position of the anode holder 105 is adjusted on the basis of the installation position of the substrate holder 103.

Figure 12:
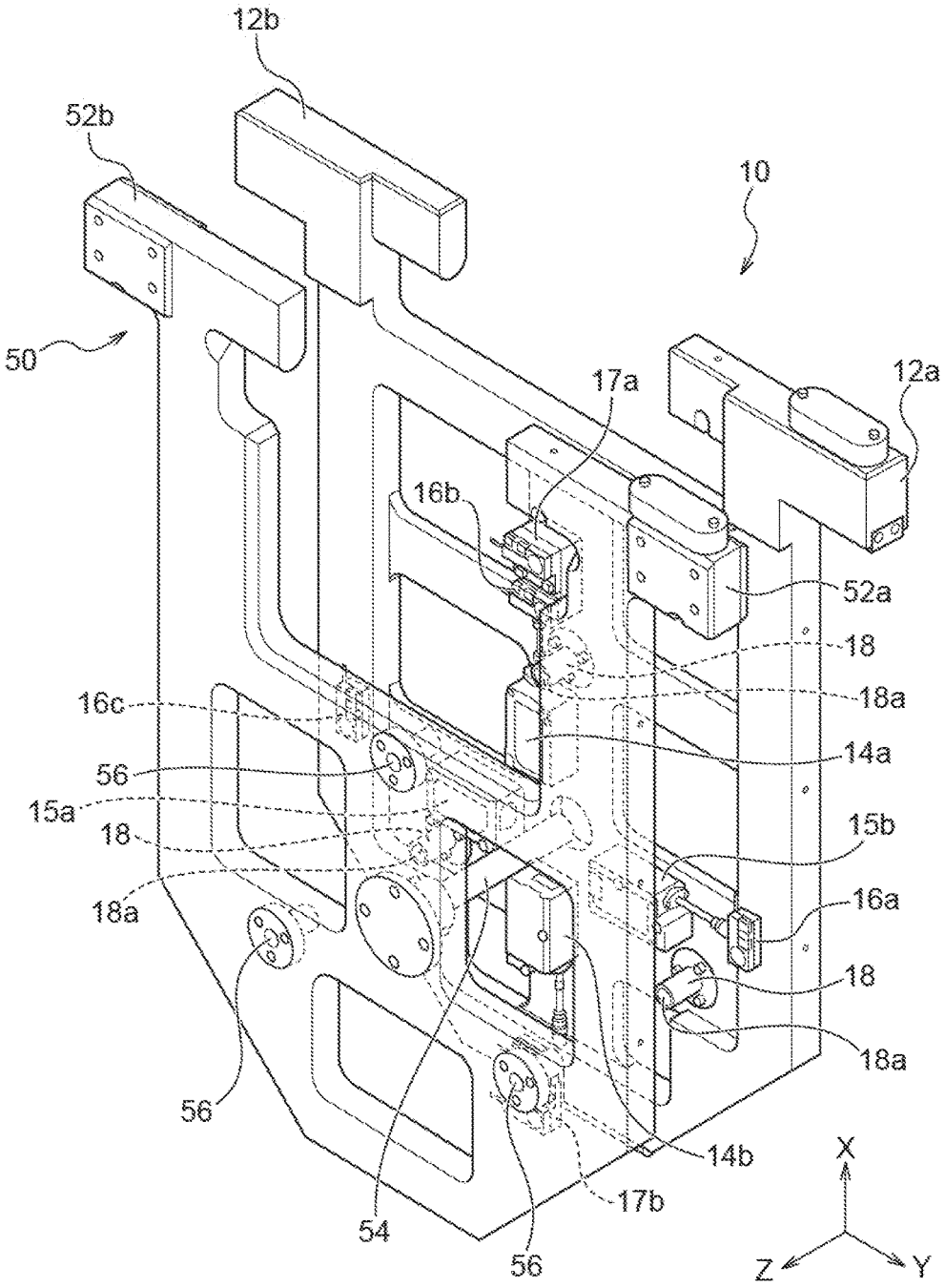
FIG. 12 is a perspective view showing the substrate holder jig and the anode holder jig in a state of being housed in the plating bath.

FIG. 12 is a perspective view showing the substrate holder jig 10 and the anode holder jig 50 in a state of being housed in the plating bath 101. The plating bath 101 is not shown in FIG. 12 for convenience. In addition, the anode holder jig 50 is shown to be transparent for convenience. As shown in FIG. 12, a tip of the center pin 54 of the anode holder jig 50 is located between the first light projecting part 14*a* and the first light receiving part 14*b* of the first laser sensor 14, and between the second light projecting part 15*a* and the second light receiving part 15*b* of the second laser sensor 15. In this state, a distance of the center pin 54 from a reference position in the X-Y flat surface is measured by the first laser sensor 14 and the second laser sensor 15. Specifically, data measured by the first laser sensor 14 and the second laser sensor 15 in the state shown in FIG. 11 is recorded in the data processing device 110 shown in FIG. 1. The data processing device 110 calculates a comparison value of the recorded data and data previously measured by the first laser sensor 14 and the second laser sensor 15 in a state where the substrate holder jig 10 and the anode holder jig 50 are fixed in a desired positional relation. The comparison value indicates the distance of the center pin 54 from the reference position.

The position of the substrate holder support part 111 and/or the position of the anode holder support part 113 that are shown in FIG. 10 are (is) adjusted based on the distance of the center pin 54 from the reference position in the X-Y flat surface, the distance being measured by the first laser sensor 14 and the second laser sensor 15. Namely, the position of the substrate holder support part 111 and/or the position of the anode holder support part 113 are (is) adjusted so that the position of the center pin 54 in the X-Y flat surface coincides with the reference position. Specifically, for example, the position of the anode holder support part 113 is made to be high by inserting a spacer between the base 114 and the anode holder support part 113. In addition, for example, the anode holder support part 113 is moved in the Y-axis direction with respect to the base 114. Hereby, installation positions (an installation position) of the substrate holder 103 and/or the anode holder support part 113 in the in-plane direction of the substrate Wf can be adjusted. Note that in a case where the position of the substrate holder support part 111 has already been adjusted with respect to the position of the plate support part 112 as shown in FIG. 11, the position of the anode holder support part 113 is preferably adjusted without changing the position of the substrate holder support part 111.

Presence/absence of a deviation of rotation angles (rotation angles around the Z-axis) of the anode holder jig 50 and the substrate holder jig 10 in the X-Y flat surface is detected by inserting the pin 37 (refer to FIG. 10 etc.) in the hole 56*a* of the anode holder jig 50 and the hole 18*a* of the substrate holder jig 10.

In a case where the above-described rotation angles are deviated, the position(s) or the angle(s) of the substrate holder support part 111 and/or the anode holder support part 113 are (is) adjusted so that the pin 37 (refer to FIG. 10 etc.) can be inserted in the hole 56*a* of the anode holder jig 50 and the hole 18*a* of the substrate holder jig 10. Specifically, for example, the position of the one anode holder support part 113 is made to be high by inserting a spacer between one of the pair of anode holder support parts 113 and the base 114. Hereby, the rotation angles of the substrate holder 103 and the anode holder support part 113 in the X-Y flat surface are adjusted. Note that in the case where the position of the substrate holder support part 111 has already been adjusted with respect to the position of the plate support part 112 as shown in FIG. 11, the position or the angle of the anode holder support part 113 is preferably adjusted without changing the position or the angle of the substrate holder support part 111.

Note that the anode holder jig 50 shown in FIG. 4 does not include outer peripheral pins corresponding to the outer peripheral pins 35*a*, 35*b*, 35*c*, and 35*d* of the plate jig 30 shown in FIG. 3. The reason is that since the anode holder 105 is arranged farther away from the substrate holder 103 than the regulation plate 106, an effect of an inclination (a degree of non-parallelism) of the anode holder 105 on in-plane uniformity of a layer formed on the substrate Wf is relatively small. Namely, the effect of the slight inclination of the anode holder 105 on the layer formed on the substrate Wf can be ignored. However, the outer peripheral pins may be provided also at the anode holder jig 50. In this case, distances from the distance sensors 16*a*, 16*b*, 16*c*, and 16*d* to the outer peripheral pins are measured by the distance sensors 16*a*, 16*b*, 16*c*, and 16*d* in a state shown in FIG. 12. The position(s) or the angle(s) of the substrate holder support part 111 and/or the anode holder support part 113 are (is) adjusted based on the measured distances.

Figure 13:
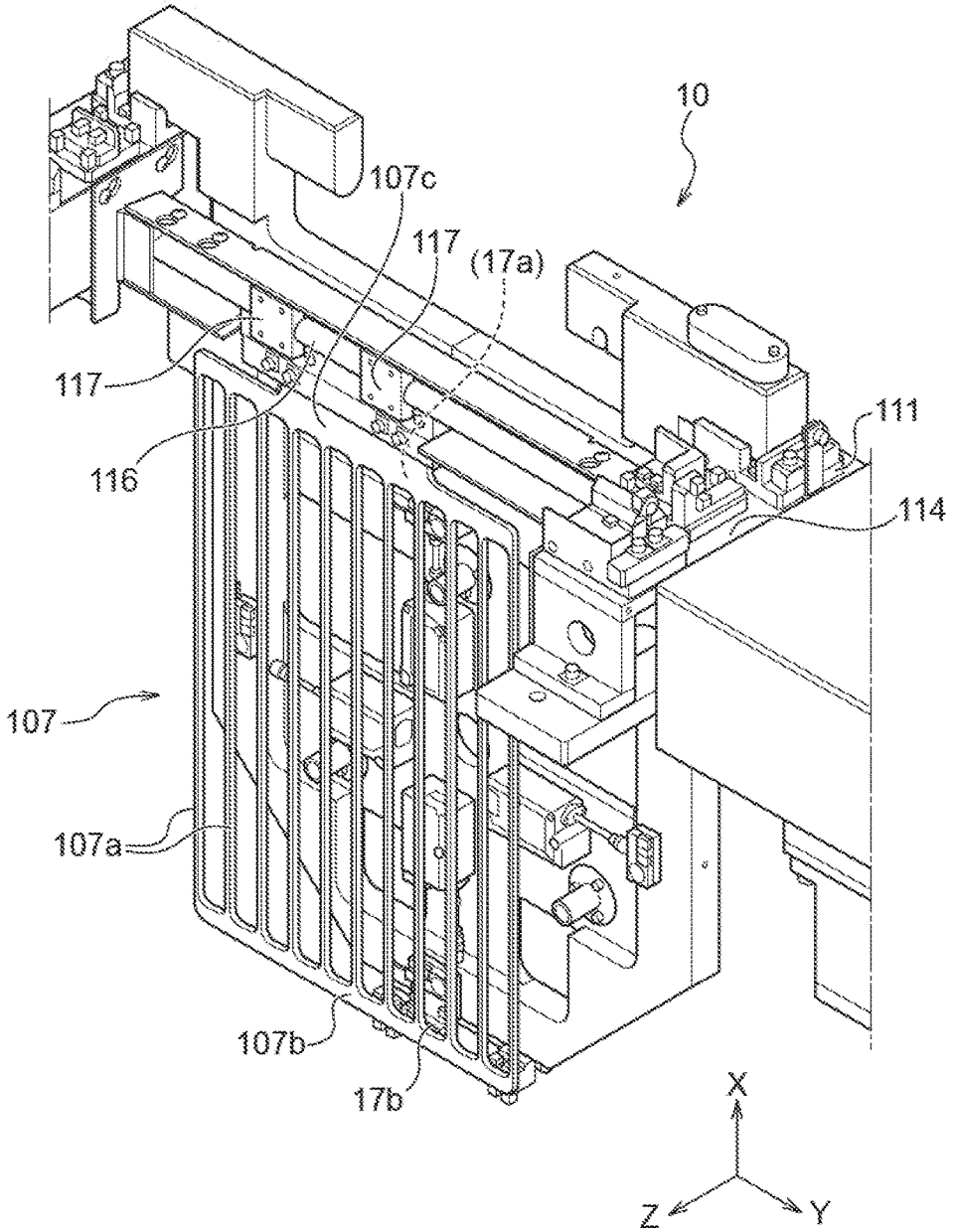
FIG. 13 is a perspective view showing the substrate holder jig and a paddle in a state of being housed in the plating bath.

FIG. 13 is a perspective view showing the substrate holder jig 10 and the paddle 107 in a state of being housed in the plating bath 101. The plating bath 101 is not shown in FIG. 13 for convenience. As shown in FIG. 13, the paddle 107 has: a plurality of rod-shaped parts 107*a* arrayed in a vertical direction; a plate-shaped lower part 107*b* combined with lower ends of the rod-shaped parts 107*a*; and a plate-shaped upper part 107*c* combined with upper ends of the rod-shaped parts 107*a*. The paddle 107 is, for example, formed of metal, such as aluminum or stainless steel.

Between the pair of bases 114, a shaft 116 extends in a horizontal direction. The shaft 116 is configured to be swingable in its axial direction. The paddle 107 is fixed to the shaft 116 by two clamps 117. The shaft 116 swings in the axial direction, and thereby the paddle 107 also swings in the axial direction.

As shown in FIG. 13, the plate-shaped upper part 107*c* and the plate-shaped lower part 107*b* of the paddle 107 are arranged close to the distance sensors 17*a* and 17*b* of the substrate holder jig 10, respectively. Note that the distance sensor 17*a* is hidden behind the plate-shaped upper part 107*c* of the paddle 107 in FIG. 13. In this state, distances from the distance sensors 17*a* and 17*b* to the plate-shaped upper part 107*c* and the plate-shaped lower part 107*b* are measured by the distance sensors 17*a* and 17*b*.

Installation positions (an installation position) of the substrate holder support part 111 and/or the paddle 107 are (is) adjusted based on the above-described distances measured by the distance sensors 17*a* and 17*b*. Specifically, an angle of the paddle 107 is adjusted so that a difference between two numerical values measured by the two distance sensors 17*a* and 17*b*, respectively, for example, becomes not more than 0.3 mm. Hereby, the substrate holder support part 111 and/or the paddle 107 are (is) adjusted so that inclinations of the substrate holder 103 and the paddle 107 around the Y-axis coincide with each other. When an angle of the paddle 107 is adjusted, first, the clamps 117 are released. Subsequently, the angle of the paddle 107 is set to be a desired one, and the shaft 116 is again gripped by the clamps 117.

Figure 14:
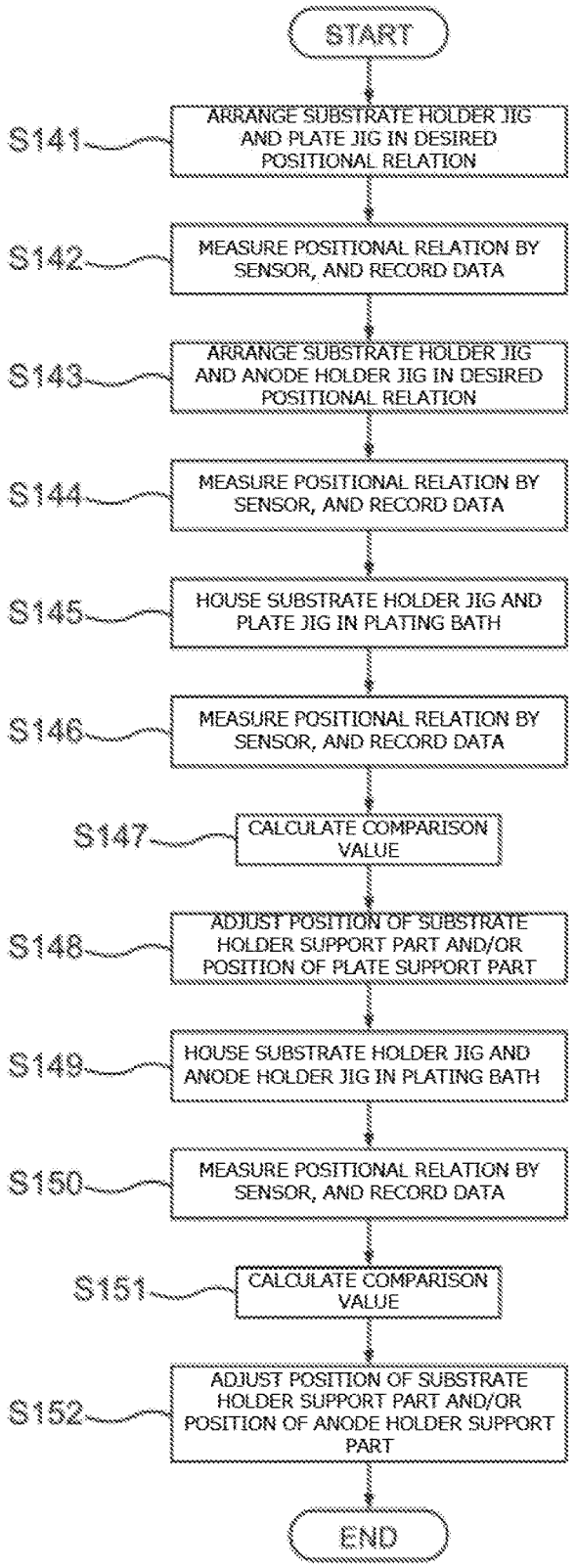
FIG. 14 is a flow chart showing a method of adjusting the plating apparatus based on data obtained by the first laser sensor, the second laser sensor, and the distance sensor.

In relation to the method of adjusting the plating apparatus explained above, processing of data obtained by the first laser sensor 14 and the second laser sensor 15, and the distance sensors 16*a*, 16*b*, 16*c*, and 16*d* will be explained. FIG. 14 is a flow chart showing the method of adjusting the plating apparatus based on the data obtained by the first laser sensor 14 and the second laser sensor 15, and the distance sensors 16*a*, 16*b*, 16*c*, and 16*d*.

First, the substrate holder jig 10 and the plate jig 30 are arranged in a desired positional relation (step S141). Subsequently, the positional relation between the substrate holder jig 10 and the plate jig 30 is measured by the first laser sensor 14 and the second laser sensor 15, and the distance sensors 16*a*, 16*b*, 16*c*, and 16*d*, and measured data (reference position data) is recorded in the data processing device 110 shown in FIG. 1 (step S142).

In addition, the substrate holder jig 10 and the anode holder jig 50 are arranged in a desired positional relation (step S143). Subsequently, the positional relation between the substrate holder jig 10 and the anode holder jig 50 is measured by the first laser sensor 14 and the second laser sensor 15, and measured data (reference position data) is recorded in the data processing device 110 shown in FIG. 1

(step S144). Note that in a case where the anode holder jig 50 includes outer peripheral pins, a positional relation between the substrate holder jig 10 and the anode holder jig 50 is measured by the distance sensors 16*a*, 16*b*, 16*c*, and 16*d*, and measured data (reference position data) is recorded in the data processing device 110 shown in FIG. 1.

The substrate holder jig 10 and the plate jig 30 are housed in the plating bath 101 shown in FIG. 1 (step S145). In this state, a positional relation between the substrate holder jig 10 and the plate jig 30 is measured by the first laser sensor 14 and the second laser sensor 15, and the distance sensors 16*a*, 16*b*, 16*c*, and 16*d*, and measured data is recorded in the data processing device 110 shown in FIG. 1 (step S146). The data processing device 110 calculates a comparison value of the data and the reference position data recorded in step S142 (step S147). The comparison value indicates a deviation to the desired positional relation between the substrate holder jig 10 and the plate jig 30.

The position of the substrate holder support part 111 and/or the position of the plate support part 112 that are shown in FIG. 10 are (is) adjusted based on the above-described comparison value (step S148). Hereby, the installation position(s) of the substrate holder 103 and/or the plate support part 112 in the in-plane direction of the substrate Wf can be adjusted. In addition, the substrate holder support part 111 and/or the plate support part 112 are (is) adjusted so that the substrate holder 103 and the regulation plate 106 are in parallel to each other.

Subsequently, the substrate holder jig 10 and the anode holder jig 50 are housed in the plating bath 101 shown in FIG. 1 (step S149). In this state, a positional relation between the substrate holder jig 10 and the anode holder jig 50 is measured by the first laser sensor 14 and the second laser sensor 15, and measured data is recorded in the data processing device 110 shown in FIG. 1 (step S150). Note that in the case where the anode holder jig 50 includes outer peripheral pins, a positional relation between the substrate holder jig 10 and the anode holder jig 50 is measured by the distance sensors 16*a*, 16*b*, 16*c*, and 16*d*, and measured data (reference position data) is recorded in the data processing device 110 shown in FIG. 1.

The data processing device 110 calculates a comparison value of the data and the reference position data recorded in step S144 (step S151). The comparison value indicates a deviation to the desired positional relation between the substrate holder jig 10 and the anode holder jig 50.

The position of the substrate holder support part 111 and/or the position of the anode holder support part 113 that are shown in FIG. 10 are (is) adjusted based on the above-described comparison value (step S152). Hereby, the installation position(s) of the substrate holder 103 and/or the anode holder support part 113 in the in-plane direction of the substrate Wf can be adjusted. In addition, in the case where the anode holder jig 50 includes the outer peripheral pins, the substrate holder support part 111 and/or the anode holder support part 113 are (is) adjusted so that the substrate holder 103 and the anode holder 105 are in parallel to each other.

As explained in the above, the installation positions of the substrate holder 103, the regulation plate 106, the anode holder 105, and the paddle 107 can be adjusted using the substrate holder jig 10, the plate jig 30, and the anode holder jig 50. By adjusting the installation positions of the substrate holder 103, the regulation plate 106, the anode holder 105, and the paddle 107, they can be installed in the plating bath 101 so that the center of the substrate Wf, the center of the anode 104, and the center of the opening part 106*a* of the regulation plate 106 are located on substantially the same straight line, and so that the substrate Wf, the anode 104, and the regulation plate 106 are substantially in parallel to each other. Eventually, in-plane uniformity of the layer formed on the substrate Wf can be improved.

In addition, the installation positions of the substrate holder 103, the regulation plate 106, the anode holder 105, and the paddle 107 can be adjusted using the same substrate holder jig 10, plate jig 30, and anode holder jig 50 for a plurality of plating apparatuses. In this case, variation in the in-plane uniformity of the layer formed on the substrate Wf can be reduced in each plating apparatus.

In addition, as is conventional, in a case where the positions of the substrate holder 103, the anode holder 105, the regulation plate 106, and the paddle 107 are adjusted based on layer thickness distribution of a plated metal layer formed on the substrate, a lot of adjustment time is required until sufficient performance can be exerted. However, according to the method of adjusting the plating apparatus of the embodiment, the adjustment time can be significantly reduced. For example, in contrast with the adjustment time conventionally having required not less than 120 days, the adjustment time can be shortened to approximately five days according to the method of adjusting the plating apparatus of the embodiment.

Hereinbefore, although the embodiment of the present invention has been explained, the above-mentioned embodiment of the invention is for facilitating understanding of the present invention, and it does not limit the present invention. The present invention may be changed and improved without departing from the spirit of the invention, and it goes without saying that equivalents of the invention are included in the present invention. In addition, each component described in claims and the specification can be arbitrarily combined or omitted in a range where at least a part of the above-mentioned problems can be solved, or a range where at least a part of effects is exerted.

Although in the embodiment, the first laser sensor 14 and the second laser sensor 15, the distance sensors 16*a*, 16*b*, 16*c*, and 16*d*, and the distance sensors 17*a* and 17*b* are provided at the substrate holder jig 10, the present invention is not limited to this. Namely, these sensors may be provided at the plate jig 30 or the anode holder jig 50. In this case, a center pin and/or outer peripheral pins are (is) provided at the substrate holder jig 10.

Figure 15:
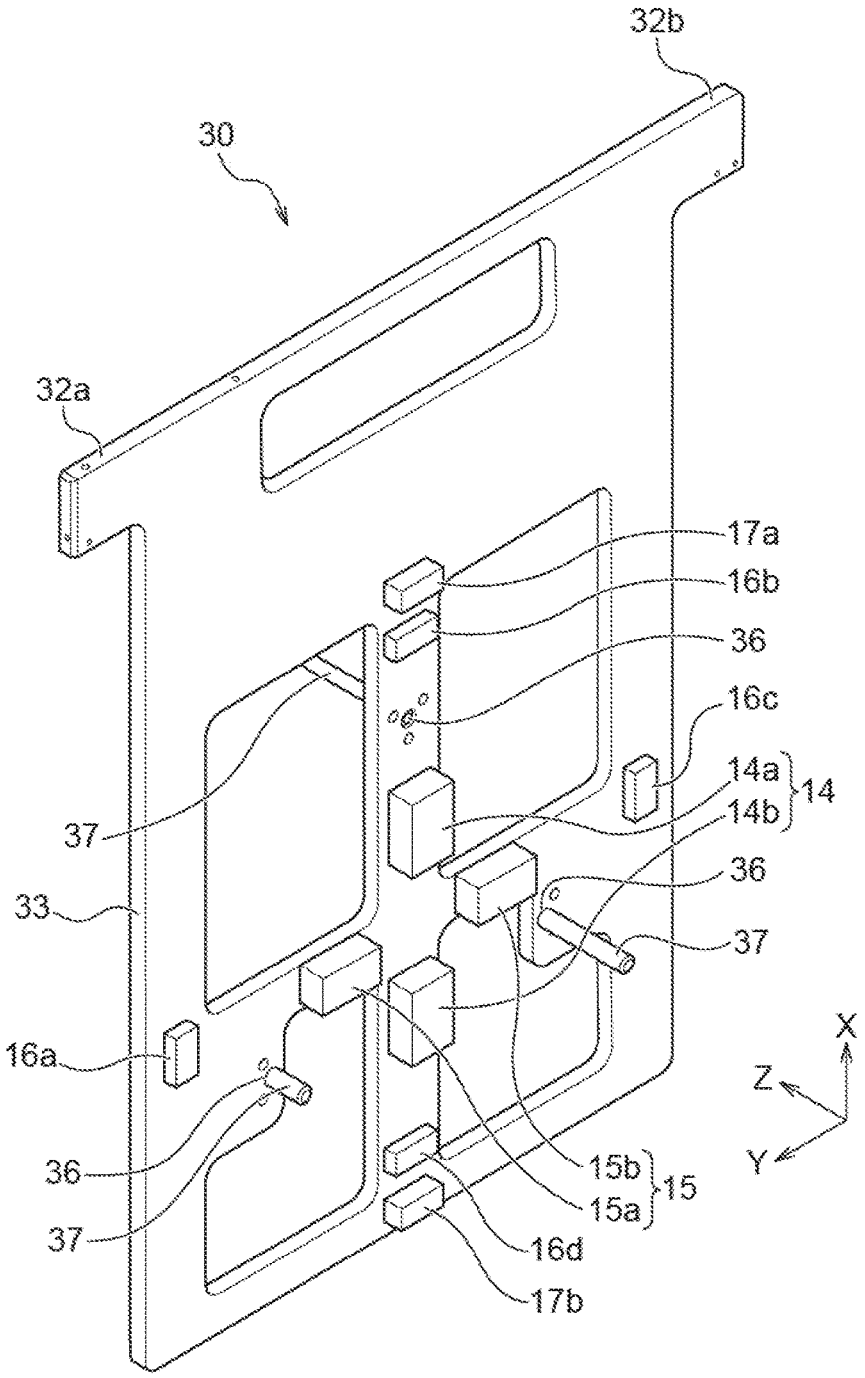
FIG. 15 is a perspective view showing the plate jig in which the first laser sensor and the second laser sensor, the distance sensor, and the other distance sensors have been provided.

FIG. 15 is a perspective view showing the plate jig 30 in which the first laser sensor 14 and the second laser sensor 15, the distance sensors 16*a*, 16*b*, 16*c*, and 16*d*, and the distance sensors 17*a* and 17*b* have been provided. As shown in FIG. 15, in a case where these sensors are provided at the plate jig 30, the respective sensors are arranged at positions corresponding to the positions of the substrate holder jig 10 in which the sensors are provided. Meanwhile, the center pin 34 and the outer peripheral pins 35*a*, 35*b*, 35*c*, and 35*d* that are provided at the plate jig 30 shown in FIG. 3 are removed. Note that each sensor in FIG. 15 is shown in a simplified manner.

Figure 16:
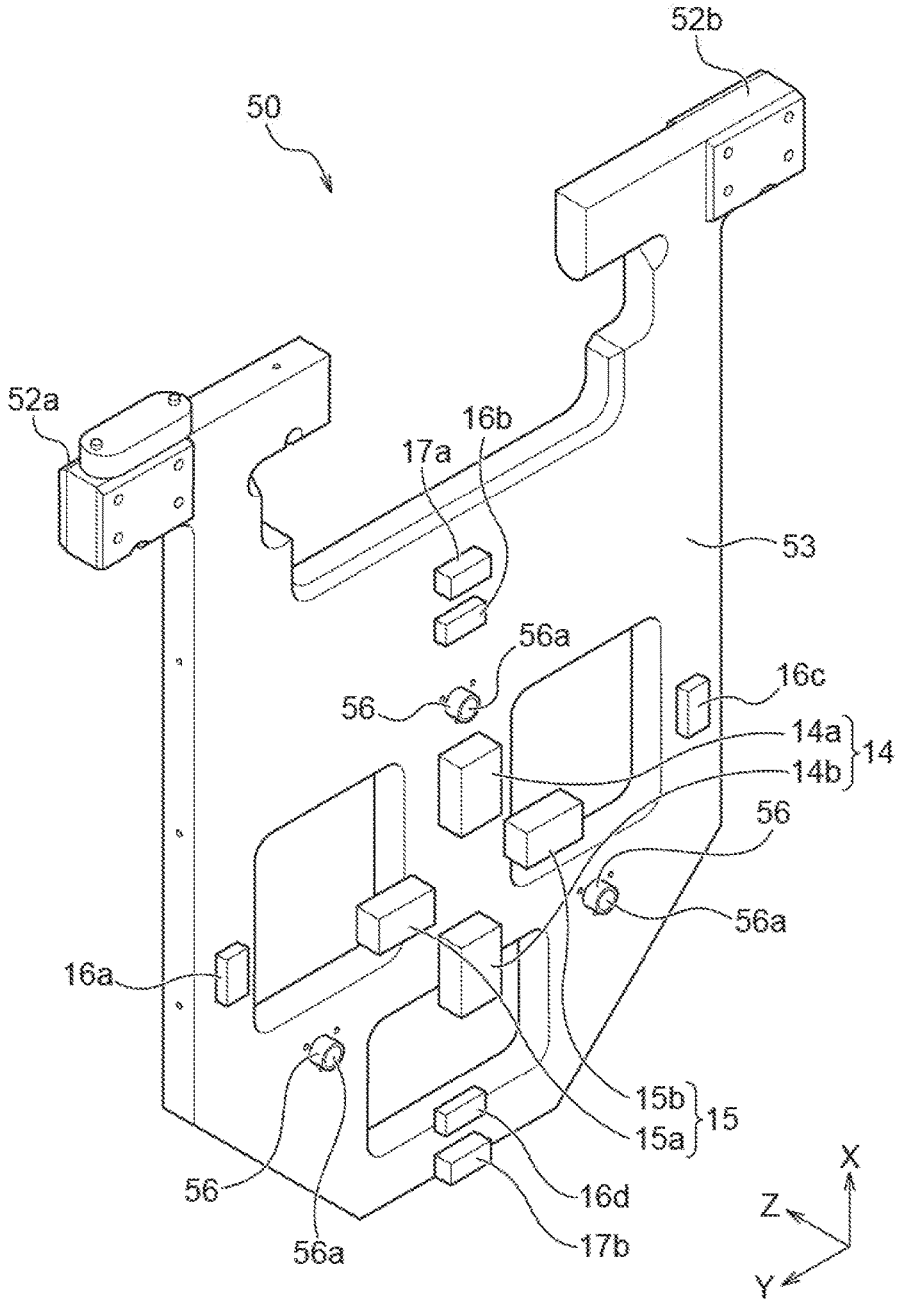
FIG. 16 is a perspective view showing the anode holder jig in which the first laser sensor and the second laser sensor, the distance sensor, and the other distance sensors have been provided.

FIG. 16 is a perspective view showing the anode holder jig 50 in which the first laser sensor 14 and the second laser sensor 15, the distance sensors 16*a*, 16*b*, 16*c*, and 16*d*, and the distance sensors 17*a* and 17*b* have been provided. As shown in FIG. 16, in a case where these sensors are provided at the anode holder jig 50, the respective sensors are arranged at positions corresponding to the positions of the substrate holder jig 10 in which the sensors are provided. Meanwhile, the center pin 54 provided at the anode holder jig 50 shown in FIG. 4 is removed. Note that in the shown anode holder jig 50, a shape of the plate-shaped part 53 is changed from that in FIG. 3 in order to attach the distance sensor 16*b* and the distance sensor 17*a* to the anode holder jig 50. In addition, each sensor in FIG. 16 is shown in a simplified manner.

Figure 17:
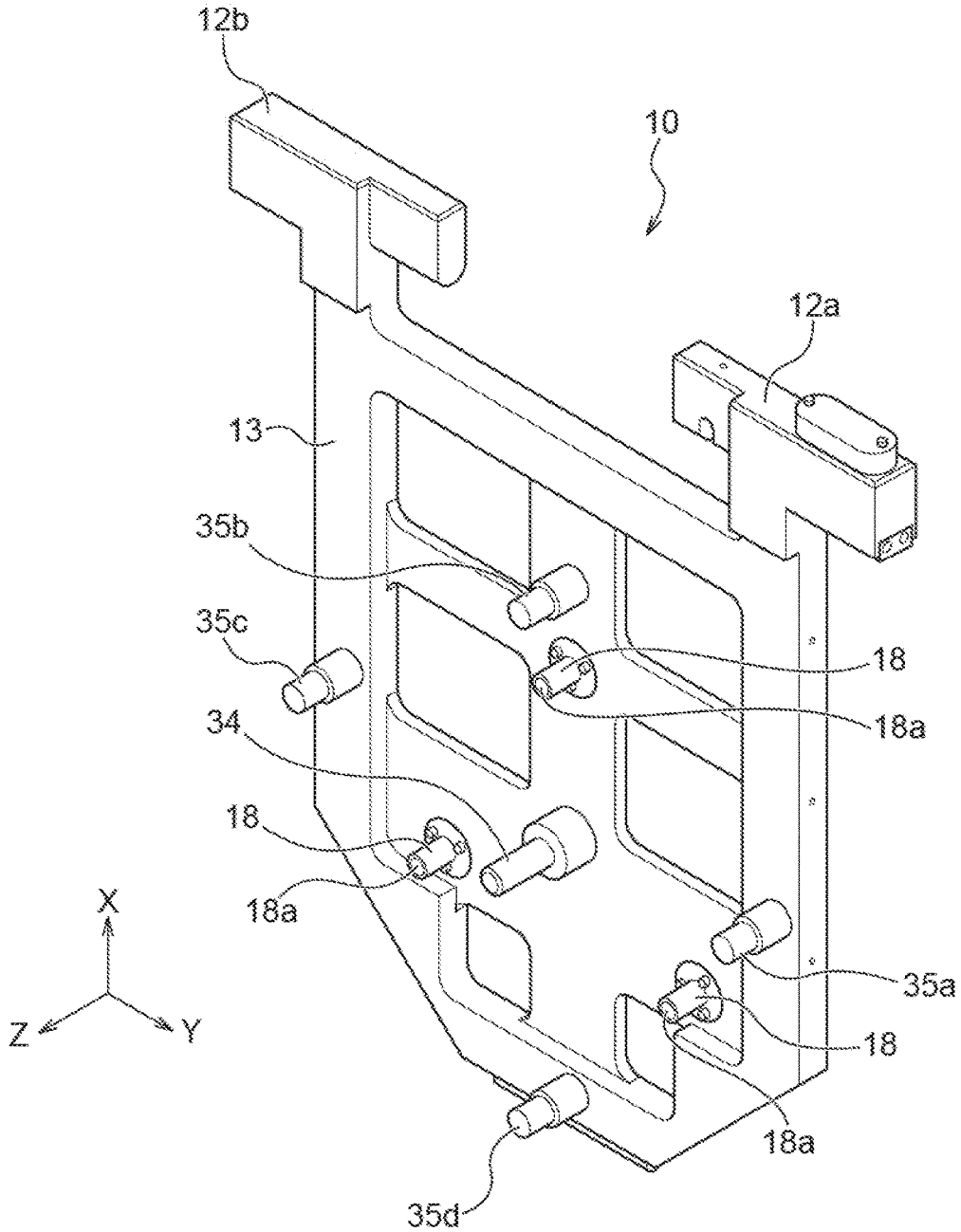
FIG. 17 is a perspective view showing the substrate holder jig in which the center pin and the outer peripheral pins have been provided.

FIG. 17 is a perspective view showing the substrate holder jig 10 in which the center pin 34 and the outer peripheral pins 35*a*, 35*b*, 35*c*, and 35*d* have been provided. As shown in FIG. 17, in a case where these pins are provided at the substrate holder jig 10, the respective pins are arranged at positions corresponding to the positions of the plate jig 30 in which the pins are provided. Meanwhile, the first laser sensor 14 and the second laser sensor 15, the distance sensors 16*a*, 16*b*, 16*c*, and 16*d*, and the distance sensors 17*a* and 17*b* that are provided at the substrate holder jig 10 shown in FIG. 2 are removed.

REFERENCE SIGNS LIST

10 substrate holder jig
14 first laser sensor
15 second laser sensor
16*a*, 16*b*, 16*c*, 16*d*, 17*a*, and 17*b* distance sensor
18*a* hole
30 plate jig
34 center pin
35*a*, 35*b*, 35*c*, and 35*d* outer peripheral pin
36 hole
37 pin
50 anode holder jig
54 center pin
56*a* hole
61 block
62 reference plate
100 plating apparatus
101 plating bath
103 substrate holder
105 anode holder
106 regulation plate
107 paddle
111 substrate holder support part
112 plate support part
113 anode holder support part

What is claimed is:

1. A method of adjusting a plating apparatus, the method comprising the steps of:

providing a plating bath configured to be able to hold a substrate holder, an anode holder, and an electric field adjusting plate;

installing a first jig at a position in the plating bath where the substrate holder is installed;

installing a second jig at a position in the plating bath where the anode holder or the electric field adjusting plate is installed;

measuring a positional relation between the first jig and the second jig installed in the plating bath using sensors included in either of the first jig and the second jig; and adjusting an installation position of the substrate holder, the anode holder, or the electric field adjusting plate based on the measured positional relation.

2. The method of adjusting the plating apparatus according to claim 1, wherein the sensors included in either of the first jig and the second jig include a position measuring sensor, the other of the first jig and the second jig has a position measuring member, the step of measuring the positional relation includes a step in which the position measuring sensor measures a distance from a reference position to the position measuring member in an in-plane direction of a surface of the first jig, the surface being opposed to the second jig, and wherein the step of adjusting the installation position includes a step of adjusting an installation position of the substrate holder, the anode holder, or the electric field adjusting plate in the in-plane direction based on the measured distance.

3. The method of adjusting the plating apparatus according to claim 2, wherein the position measuring member is a position measuring pin that protrudes toward the opposing first jig or second jig, and wherein the position measuring sensor is configured to be able to numerically display a distance from a reference position to the position measuring pin in an in-surface direction of the substrate holder.

4. The method of adjusting the plating apparatus according to claim 2, comprising the steps of:

arranging in a desired positional relation the first jig and the second jig that have not been installed in the plating bath; and measuring the reference position of the position measuring member by the position measuring sensor in a state where the first jig and the second jig are arranged in the desired positional relation.

5. The method of adjusting the plating apparatus according to claim 1, wherein the sensors included in either of the first jig and the second jig include at least three distance measuring sensors, the other of the first jig and the second jig has a distance measuring member, the step of measuring the positional relation includes a step in which the distance measuring sensor measures a distance from the distance measuring sensor to the distance measuring member, and wherein the step of adjusting the installation position includes a step of adjusting an inclination of the substrate holder, the anode holder, or the electric field adjusting plate, or a position thereof in a normal direction of the substrate holder, based on the measured distance.

6. The method of adjusting the plating apparatus according to claim 5, wherein the distance measuring member is a distance measuring pin that protrudes toward the opposing first jig or second jig, and wherein the distance measuring sensor is configured to be able to numerically display a distance from the distance measuring sensor to the distance measuring pin.

7. The method of adjusting the plating apparatus according to claim 5, comprising the steps of:

arranging in a desired positional relation the first jig and the second jig that have not been installed in the plating bath; and measuring a distance to the distance measuring member by the distance measuring sensor in a state where the first jig and the second jig are arranged in the desired positional relation.

8. The method of adjusting the plating apparatus according to claim 1, wherein the first jig and the second jig have at least two angle measuring reference positions, respectively, the step of measuring the positional relation includes a step of detecting presence/absence of a deviation of rotation angles of the angle measuring reference position formed at the first jig and the angle measuring reference position formed at the second jig, the rotation angles being around the normal direction of the substrate holder, and wherein the step of adjusting the installation position includes a step of adjusting the rotation angle of the substrate holder, the anode holder, or the electric field adjusting plate based on the measured deviation of the rotation angles.

9. The method of adjusting the plating apparatus according to claim 8, wherein the first jig and the second jig have angle measuring holes in the angle measuring reference positions, respectively, and wherein the step of measuring the positional relation includes a step of detecting the presence/absence of the deviation of the rotation angles by inserting an angle measuring pin in the angle measuring hole formed in the first jig and the angle measuring hole formed in the second jig.

10. The method of adjusting the plating apparatus according to claim 9, comprising the steps of:

arranging in a desired positional relation the first jig and the second jig that have not been installed in the plating bath; and aligning positions of the angle measuring hole formed in the first jig and the angle measuring hole formed in the second jig in a state where the first jig and the second jig are arranged in the desired positional relation.

11. The method of adjusting the plating apparatus according to claim 1, wherein the plating apparatus has a paddle provided between the anode holder and the substrate holder, and wherein the method comprises the steps of:

measuring a positional relation between the first jig and the paddle installed in the plating bath; and adjusting an installation position of the substrate holder or the paddle based on the measured positional relation.

* * * * *